US006033065A

United States Patent [19]

Ikezaki

[11] Patent Number: 6,033,065

[45] Date of Patent: Mar. 7, 2000

[54] HOT MELT INK JET PRINT HEAD

[75] Inventor: Yoshiyuki Ikezaki, Nagoya, Japan

[73] Assignee: Brother Kogyo Kabushiki Kaisha, Nagoya, Japan

[21] Appl. No.: 08/969,153

[22] Filed: Nov. 12, 1997

[30] Foreign Application Priority Data

Nov. 15, 1996 [JP] Japan ..... 8-305324

[51] Int. Cl.[7] ..... M41J 2/05

[52] U.S. Cl. ..... 347/88; 347/99

[58] Field of Search ..... 347/17, 85, 88, 347/89, 99, 60

[56] References Cited

U.S. PATENT DOCUMENTS 4,814,786 3/1989 Hoisington et al. ..... 347/88

5,159,355 10/1992 Horio et al. ..... 347/60

5,424,767 6/1995 Alavizadel et al. ..... 347/88

*Primary Examiner*—N. Le.

*Assistant Examiner*—Anh T. N. Vo

*Attorney, Agent, or Firm*—Oliff & Berridge, PLC

[57] ABSTRACT

A main chamber and a sub chamber of an ink tank are defined by a common bottom wall. The bottom wall is formed with cave-in at its under surface. Also, the bottom wall is formed with two through holes at the caved-in portion, each at a respective chamber. A tank heater including insulating sheet attached over the under surface of the bottom wall while defining a channel. In this way, the main chamber and the sub chamber is connected via the channel defined by the bottom wall and the ink heater.

25 Claims, 18 Drawing Sheets

HOT MELT INK JET PRINT HEAD

This application is related to co-pending Application No. 08/968,161, filed Nov. 12, 1997; co-pending Application No. 08/968,557, filed Nov. 12, 1997; co-pending Application No. 08/969,015, filed Nov. 12, 1997; and co-pending Application No. 08/969,150, filed Nov. 12, 1997.

BACKGROUND OF THE INVENTION

1. Field of the Invention

The present invention relates to a hot melt ink jet print head.

2. Description of Related Art

As shown in FIG. 1, a conventional print head used in a hot melt ink jet printer (hereinafter referred to as "printer") includes an ink tank PA1, a deaerator PA8, a nozzle head PA5, a compressor PA22, an ink supply unit PA32, and a filter PA33. The ink tank PA1 is made of aluminum alloy using a die-casting method. The ink tank PA1 includes a partition wall which divide the ink tank PA1 into a main chamber PA2 and a sub chamber PA3. The partition wall is formed with a hole serving as a channel PA4. Hot melt ink X (hereinafter referred to as "ink") is stored and melted in the ink tank PA1. The deaerator PA8 includes an air-permeable thin film PA81 and a negative pressure generating device PA82. The deaerator PA8 defines the ink supply channels PA6, PA7. The negative pressure generating device PA82 absorbs air bubbles contained in the ink X. The nozzle head PA5 injects the ink X as an ink droplet onto a recording medium. The nozzle head PA5 is in a fluid communication with the main chamber PA2 via the ink supply channel PA6 and also with the sub chamber PA3 via the ink supply channel PA7.

Internal air pressure of the main chamber PA2 is normally maintained at normal atmospheric pressure, and is increased by a compressor PA22 linked to a pressure regulating opening PA21.

The ink supply unit PA32 supplies the ink X to the sub chamber PA3 through an ink supply opening PA31. The filter PA33 provided near the ink supply opening PA31 removes any foreign matter from the ink X.

A one-way valve PA41 is provided to the channel PA4 and regulates flow of the ink X so that the ink X can flow from the sub chamber PA3 to the main chamber PA2 but not backwards.

A melting point of the ink X is much higher than room temperature. Therefore, when the printer is turned OFF after an printing operation, the ink X starts cooling off and being solidified as decreasing its volume. As a result, air spaces are formed within the ink supply channels PA6, PA7. When the printer is turned ON next time and starts melting the ink X, the air in the ink supply channels PA6, PA7 is trapped and forms air bubbles in the melted ink X. If these air bubbles are ejected along with the ink X from the nozzle head PA5, the ejected ink droplet has a smaller volume than a normal one by a volume of the air bubbles contained in the ejected droplet. As a result, the desired printed image cannot be obtained.

In order to overcome the above-described problems, the air bubbles are removed from the ink supply channels at the start up of the printer. More specifically, the compressor PA22 increases the internal pressure of the main chamber PA2. The ink X is circulated through the ink supply channel PA6, nozzle head PA5, and ink supply channel PA7 and to the sub chamber PA3. In this way, the air bubbles in the ink supply channels PA6, PA7 are collected into the sub chamber PA3.

Then, the printing operation is started. As the print head moves back and forth during the printing operation, an inertial force is generated on the ink X. As a result, the ink X flows from the sub chamber PA3 into the main chamber PA2. Because the one-way valve PA41 prevents the ink X in the main chamber PA2 from returning to the sub chamber PA3, ink level difference h is generated between two chambers PA2, PA3 as shown in FIG. 1. Then, in order to equalize the ink levels, the ink X in the main chamber PA2 slowly flows through the ink supply channel PA6, nozzle head PA5, and ink supply channel PA7 and to the sub chamber PA3.

However, when the ink X is ejected from the nozzle head PA5, a suction force works on the ink supply channels PA6, PA7, thereby the ink X flows in an opposite direction, that is, from the sub chamber PA3 to the nozzle head PA5. Hence, the air bubbles once collected into the sub chamber PA3 are lead to the nozzle head PA5 with the ink X.

In order to prevent the air bubbles from reaching the nozzle head PA5, the deaerator PA8 sucks and removes the air bubbles out of the ink X.

As described above, the partition wall of the ink tank is formed with the through hole serving as the channel PA4. This through hole is formed after the ink tank PA1 is once made from an aluminum alloy using a die-casting method. However, because the print head is relatively small, it is difficult and time consuming to form a hole on the partition wall.

SUMMARY OF THE INVENTION

It is the objective of the present invention to solve the above-described problems and to provide a hot melt ink jet print head in which a channel connecting between a main chamber and a sub chamber of an ink tank can be formed in a simple method.

Those and other object of the present invention will be attained by a head for use in a hot melt ink jet printer, the head including an ink tank, a nozzle head that ejects ink, a front panel, a tank heater, and a panel heater. The head is mounted on a carriage of the printer. The ink tank stores ink and is formed with a first chamber and a second chamber. The ink tank has a common bottom wall defining the first chamber and the second chamber. The common bottom wall is formed with a cave-in with a first through hole at the first chamber side and a second through hole at the second chamber side. The cave-in and the holes together form a first channel connecting between the first chamber and the second chamber. The nozzle head is mounted on the front panel. The front panel is formed with a second channel connecting between the first chamber and the nozzle head and a third channel connecting between the nozzle head and the second chamber so that ink is allowed to flow from the first chamber to the second chamber via the nozzle head. The tank heater heats the ink tank and is attached to the common bottom wall while defining the first channel. The panel heater heats and attaches to the front panel.

BRIEF DESCRIPTION OF THE DRAWINGS

The particular features and advantages of the invention as well as other objects will become more apparent from the following description taken in connection with the accompanying drawings, in which:

FIG. 4(*b*) is a cross-sectional view taken along a line A—A of FIG. 3;

FIG. 7(*b*) is a cross-sectional view taken along a line C—C of FIG. 6;

FIG. 9(*b*) is a plan view of an ink tank heater 17 according to the embodiment of the present invention;

FIG. 10(*b*) is a plan view showing the front panel heater 33;

FIG. 11(*b*) is a cross-sectional view of the filter 29 of FIG. 11(*a*);

DETAILED DESCRIPTION OF THE PREFERRED EMBODIMENT

A print head used in an ink jet print head according to a preferred embodiment of the present invention will be described while referring to the accompanying drawings. In the following description, the expressions "above", "under", "right", "left", "upper", and "lower" are used throughout the description to define the various parts when the printer is disposed in an orientation in which it is intended to be used.

Figure 1:
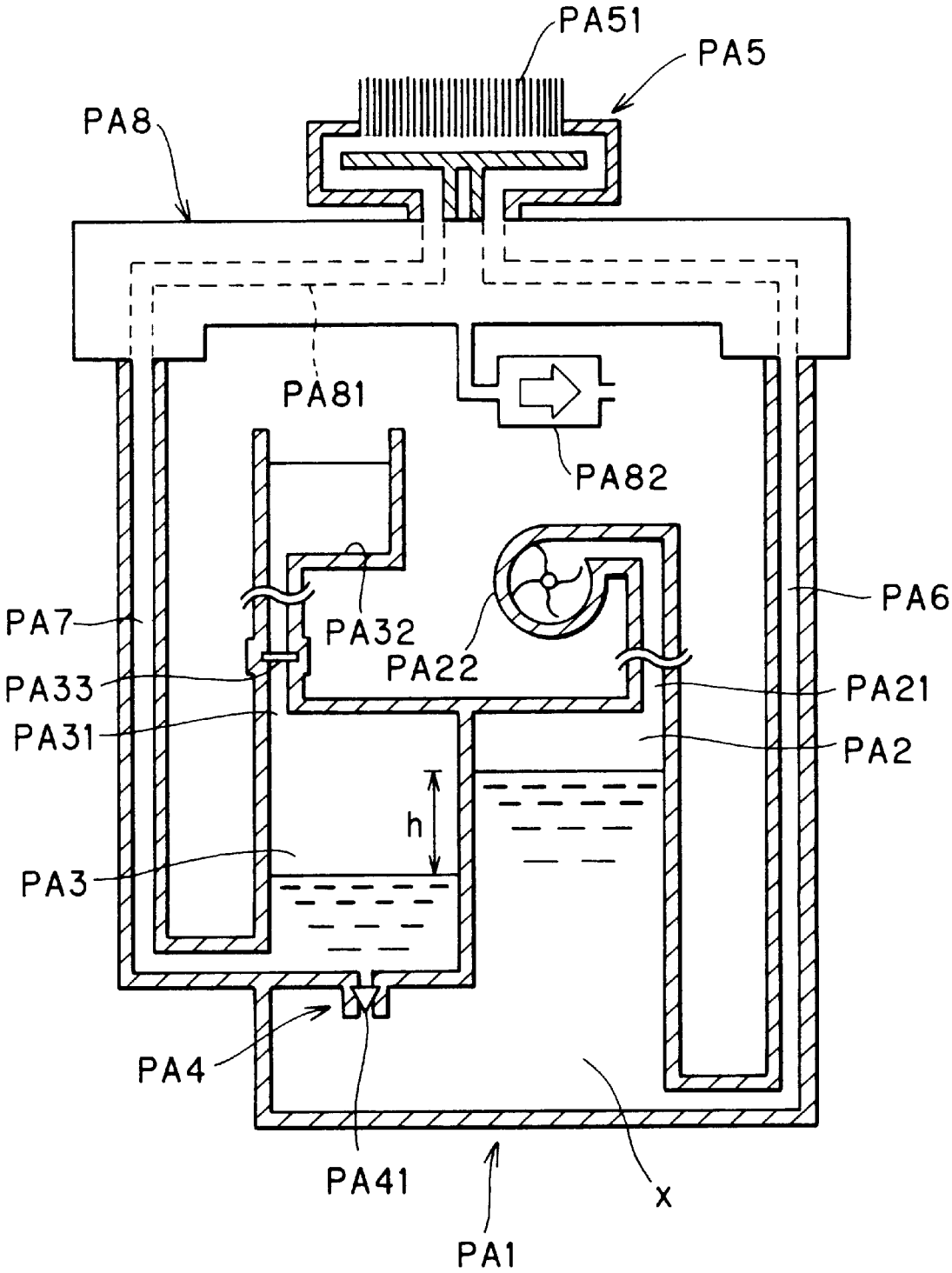
FIG. 1 PRIOR ART
FIG. 1 is an explanatory diagram for a print head of the prior art.
Figure 2:
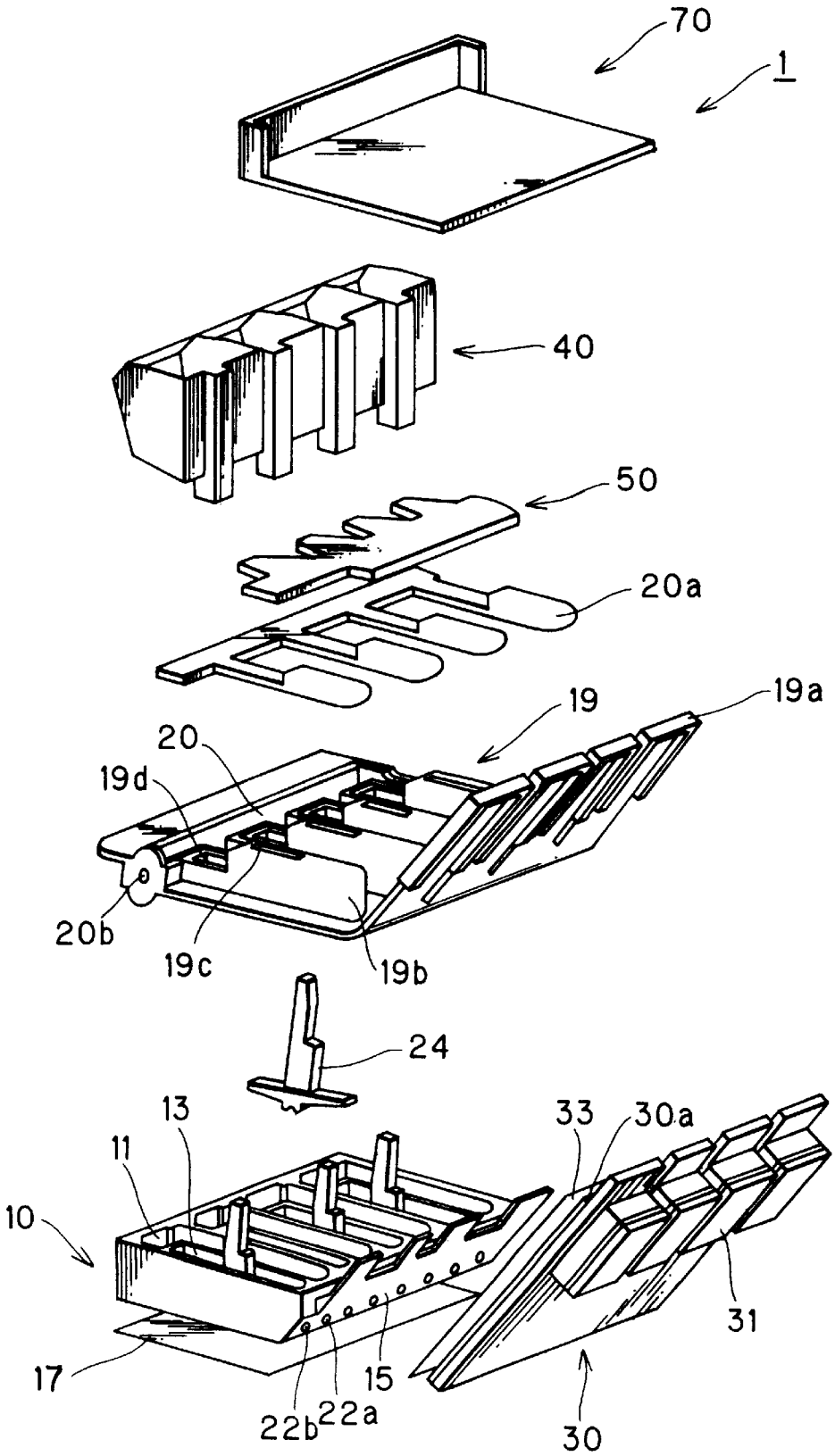
FIG. 2 is an exploded view showing a print head 1 according to an embodiment of the present invention.
Figure 4A:
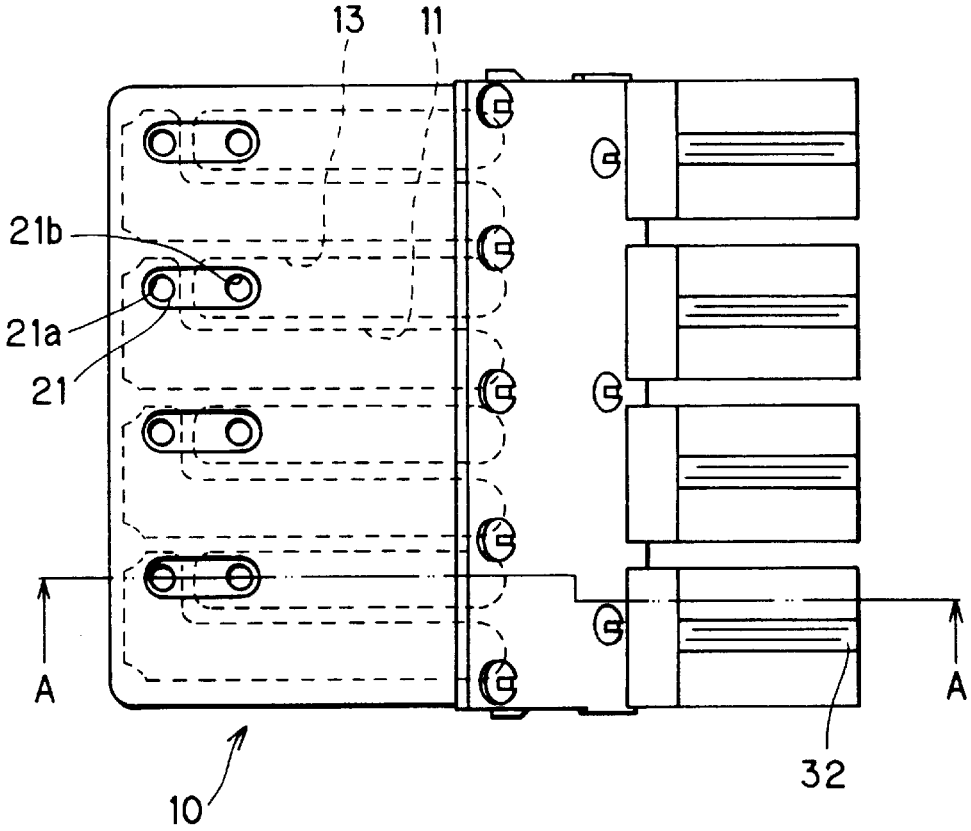
FIG. 4(*a*) is a phantom view of the ink tank 10 of FIG. 3 as viewed from the bottom.
Figure 4B:
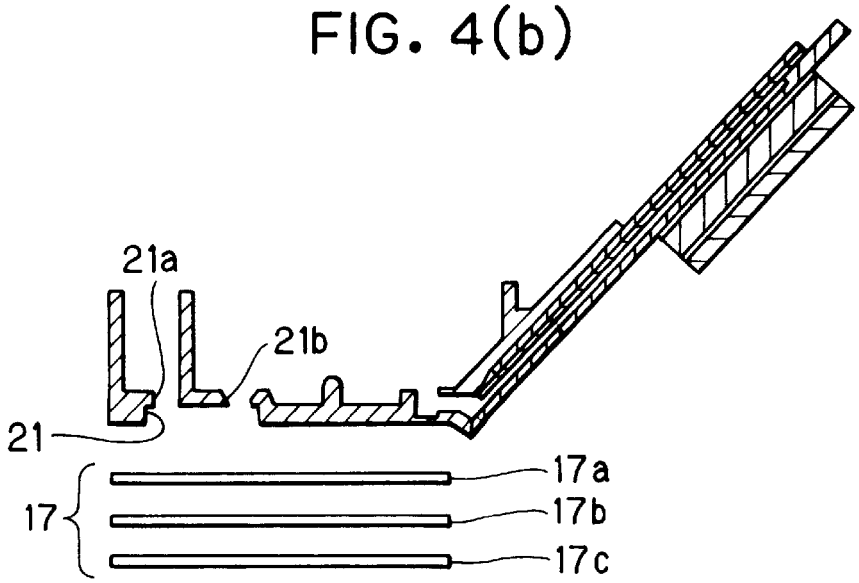

As shown in FIG. 2, the print head 1 includes an ink tank 10, a front panel 30, a melting tank 40, a cam 50, and a control substrate base 70. The ink tank 10 includes a slanted front surface member 15, four pairs of main chambers 11 and sub chambers 13, an ink tank top cover 19, and an ink tank heater 17. The front panel 30 is mounted on the slanted front surface member 15. Each pair of the main chamber 11 and sub chamber 13 stores one of four different colored ink, that is, yellow, magenta, cyan, and black. The ink tank heater 17 is attached to an underside of the ink tank 10. As shown in FIG. 4(*a*), a channel 21 is formed underneath of the corresponding pair of the main chamber 11 and sub chamber 13.

Figure 3:
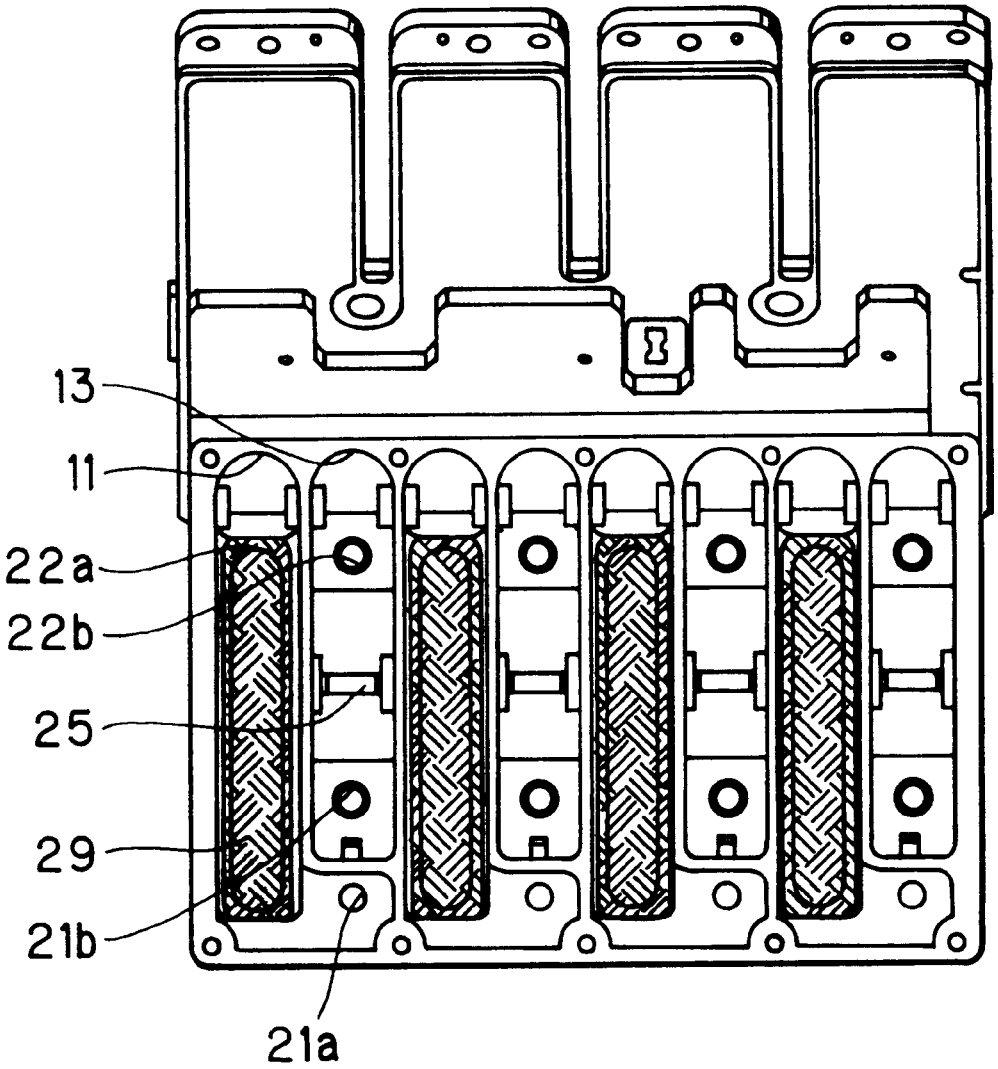
FIG. 3 is a cross-sectional view of an ink tank 10 according to the embodiment of the resent invention.
Figure 11A:
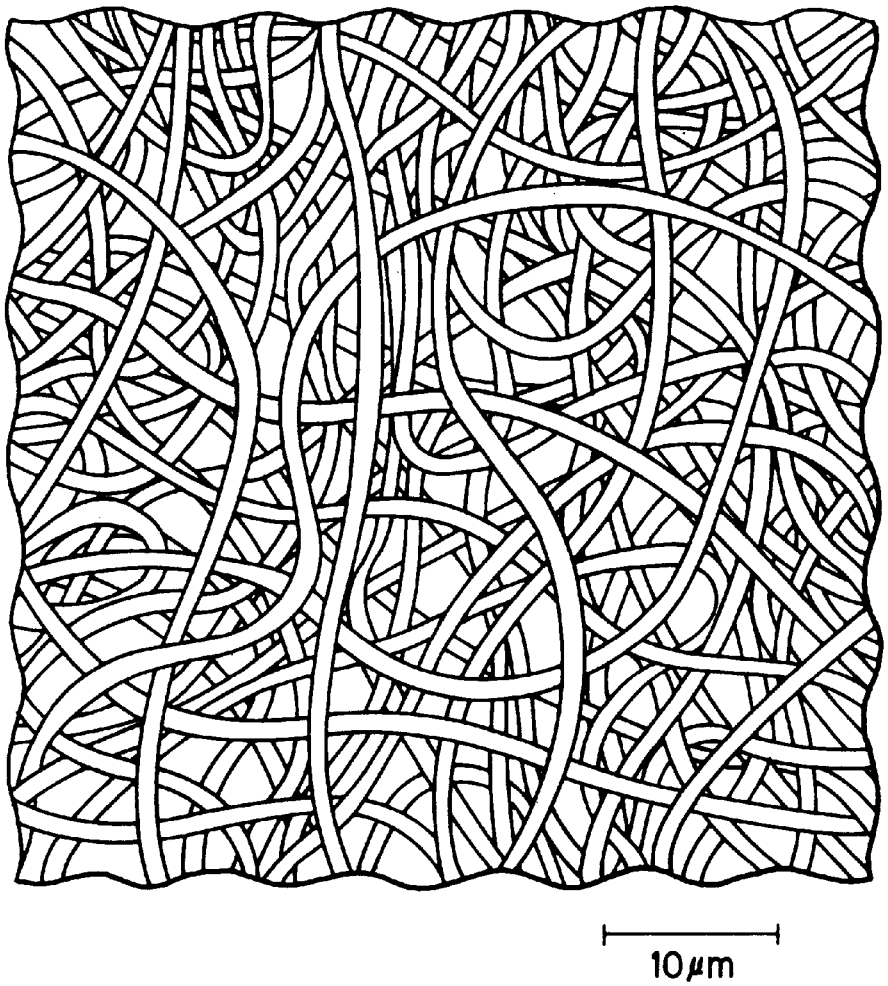
FIG. 11(*a*) is a plan view showing a filter 29 according to the embodiment of the present invention.
Figure 11B:
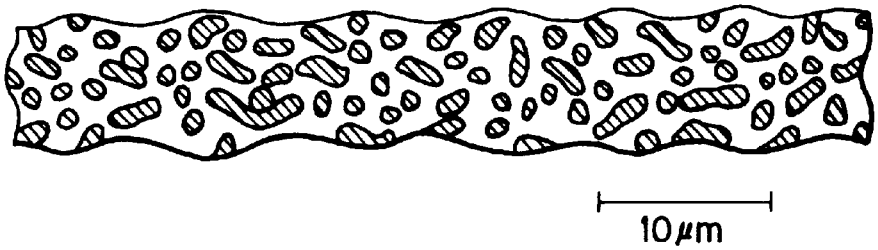

As shown in FIG. 3, the main chamber 11 is L-shaped as viewed from the above. The main chamber 11 is in a fluid communication with the channel 21 and the front panel 30 via a main chamber inlet 21*a* and a main chamber outlet 22*a*, respectively. A filter 29 is provided to each of the main chambers 11. For example, Tommy Fileck SS (registered trademark), a product of Tomoegawa Paper Inc, can be used for the filter 29. This type of filter 29 is formed from stainless steel fibers, which are sintered into a paper-like condition and then pressed. As shown in FIG. 11, the fibers are complexly twisted and overlapped to form multiple layers, thereby forming a three-dimensional passages having a certain thickness. It should be noted that instead of stainless steel fibers, PTFE fibers can be used for the filter 29.

Figure 6:
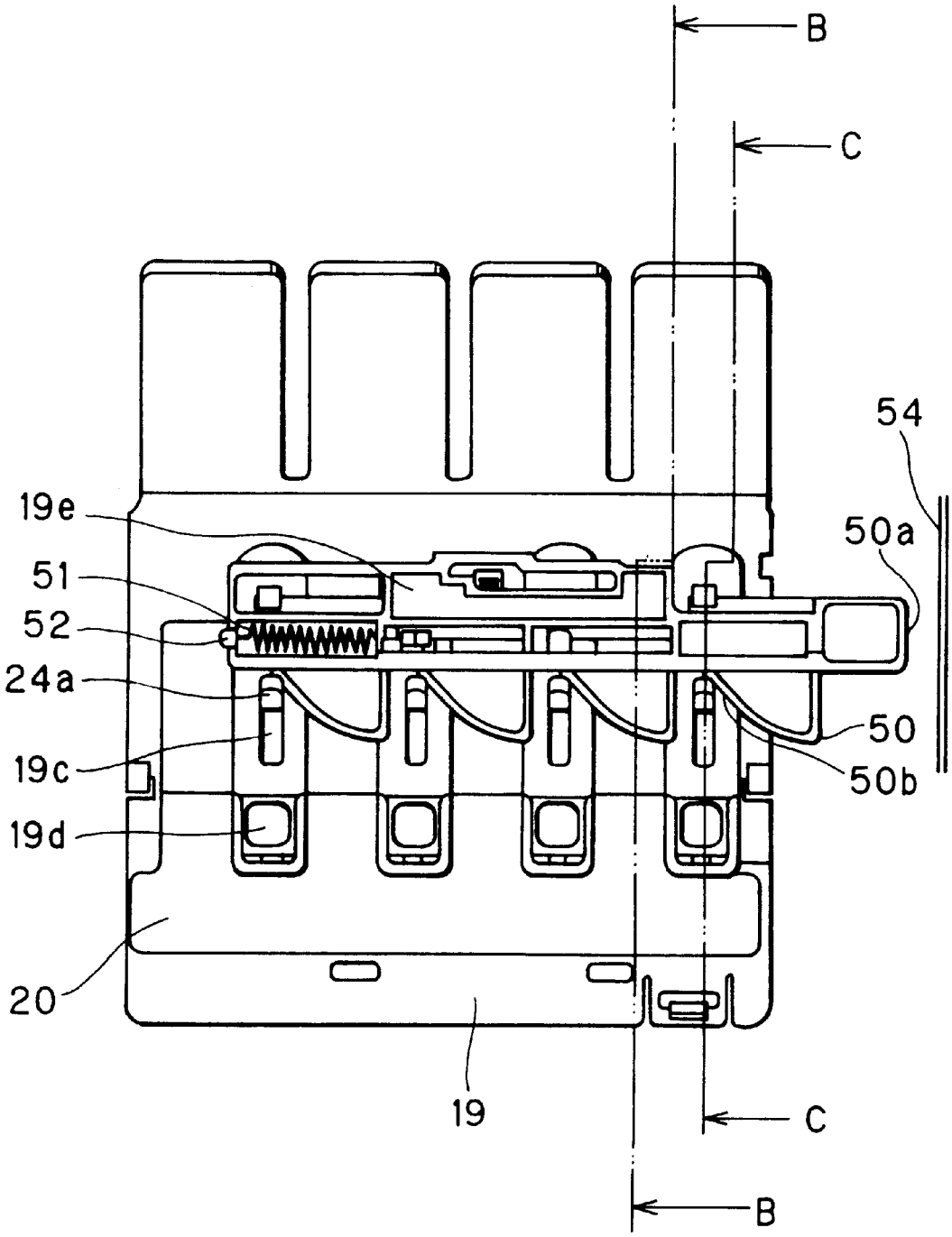
FIG. 6 is cross-sectional view of the ink tank 10 of FIG. 3.
Figure 7A:
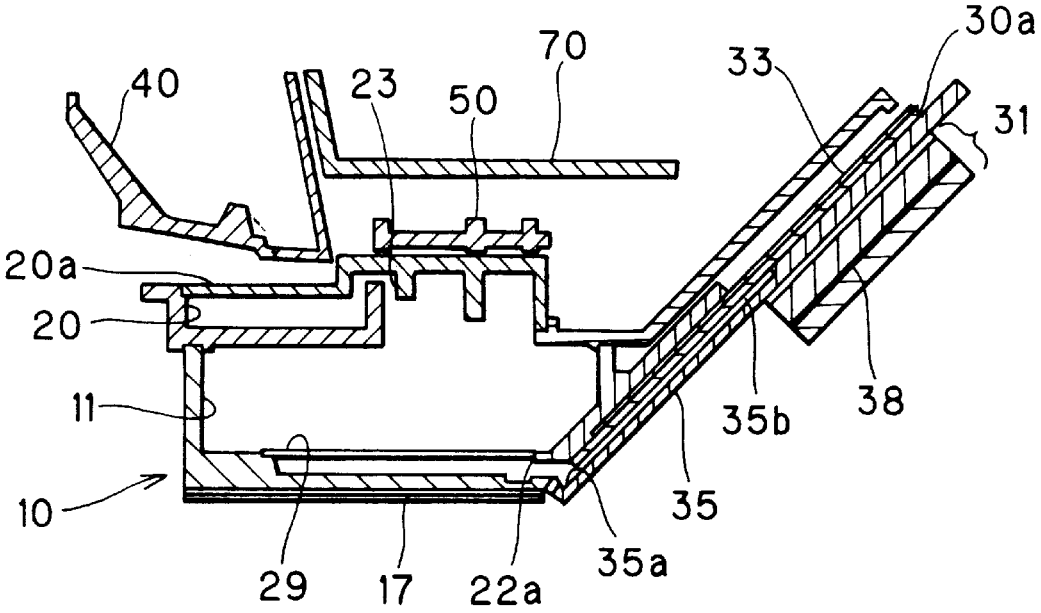
FIG. 7(*a*) is a cross-sectional view taken along a line B—B of FIG. 6.
Figure 7B:
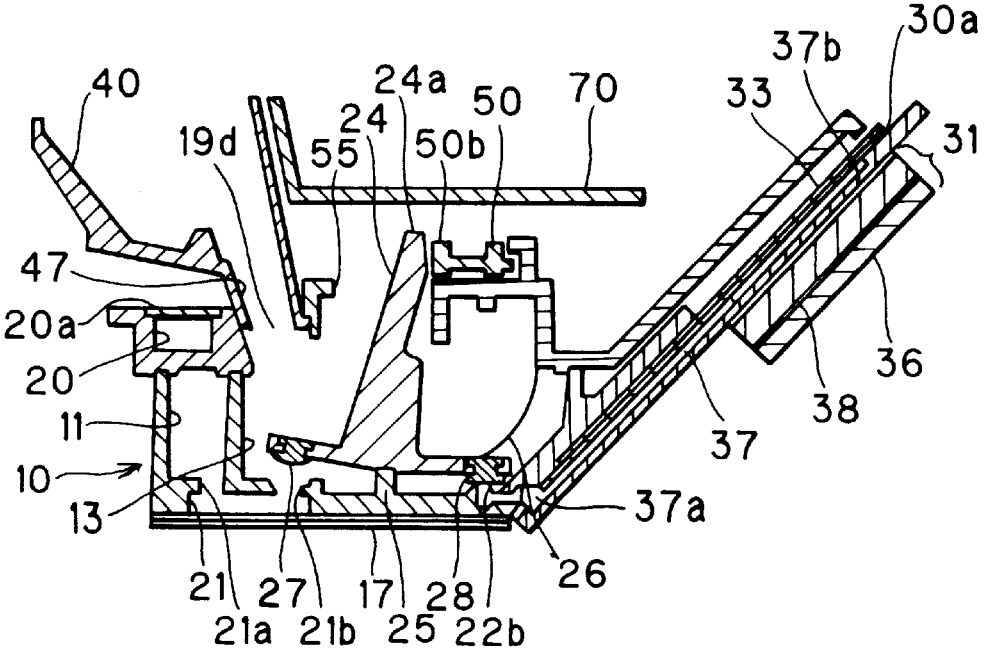
Figure 8:
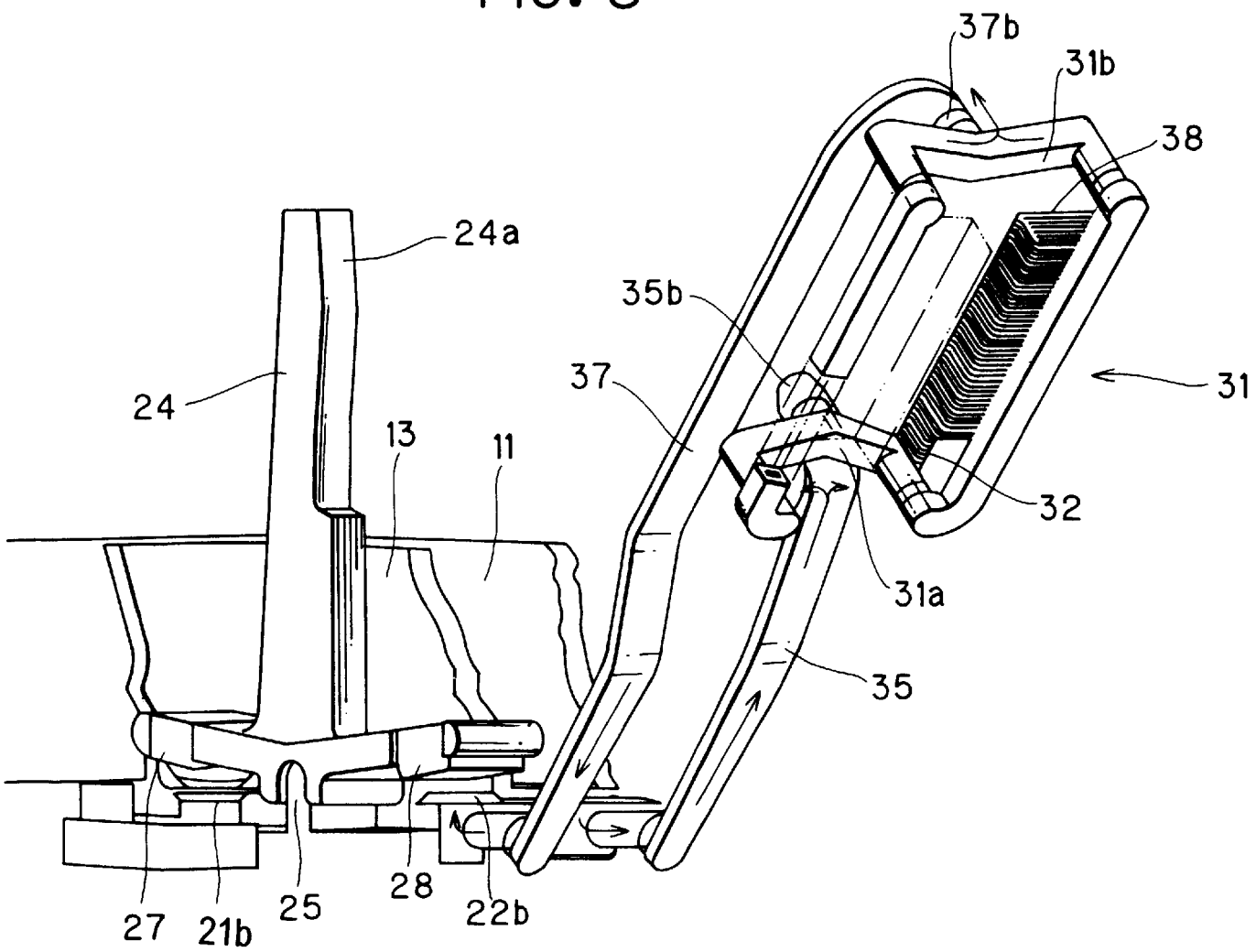
FIG. 8 is a perspective view showing an ink flow in the print head 1.

The sub chamber 13 is in a fluid communication with the corresponding channel 21 and the front panel 30 via a sub chamber outlet 21*b* and a sub chamber inlet 22*b*, respectively. As shown in FIGS. 6 to 8, a bottom surface of the sub chamber 13 is formed with a lever fulcrum 25 between the sub chamber outlet 21*b* and sub chamber inlet 22*b*. Also, as shown in FIG. 2, a lever 24 formed of die-cast aluminum alloy is pivotally mounted on the lever fulcrum 25. The lever 24 is substantially reverse T shaped, having an arm extending in a horizontal direction and an upright portion extending from a middle of the arm. Pressure welding valves 27 and 28 are attached to the lever 24 at either one of ends of the arm. When the pressure welding valve 27 closes off the sub chamber outlet 21*b*, the sub chamber inlet 22*b* is opened. On the other hand, when the pressure welding valve 27 closes off the sub chamber inlet 22*b*, the sub chamber outlet 21*b* is opened.

As shown in FIG. 7(*b*), a spring 26 constantly urges the lever 24 to close the sub chamber inlet 22*b* with the pressure welding valve 28. The pressure welding valve 28 has a flat surface, while an edge of the sub chamber inlet 22*b* has annularly shaped surface which is protruding upwardly. On the other hand, the pressure welding valve 27 has a spherically shaped surface, while an edge of the sub chamber outlet 21*b* has a tapered surface. The pressure welding valves 27, 28 are made of an elastomer such as, silicone rubber and a fluorine-containing rubber, which has a Shore hardness of 40° C and a heat resistance of about 200° C.

As shown in FIG. 2, the ink tank top cover 19 includes a front panel cover member 19*a*, sub chamber cover members 19*b*, and an air chamber cover 20*a*. The front panel cover member 19*a* is in association with the front panel 30. Each sub chamber cover members 19*b* define the sub chamber 1. Also, the ink tank top cover 19 is formed with elongated openings 19*c*, ink input ports 19*d*, an air chamber 20, a through hole 20*b*. An upper end 24*a* of the lever 24 protrudes through the elongated openings 19*c*. The ink input port 19*d* supplies ink stored in the melting tank 40 to the corresponding sub chamber 13.

A compressor, not shown in the drawings, supplies compressed air to the main chambers 11 through the through hole 20*b* and the air chamber 20. The air chamber cover 20*a* covers over the air chamber 20. Also, as shown in FIG. 7(*a*), the ink tank top cover 19 is formed with through hole 23 which is connected to the main chambers 11.

As shown in FIG. 4(*b*), the ink tank heater 17 includes an AC heater 17*a*, a DC heater 17*b*, and an insulating sheet 17*c*.

The AC heater 17*a* has a thickness of 55 μm and is attached to the underside of the ink tank 10 while forming the channel 21. The DC heater 17*b* has a thickness of 55 μm and is attached to an underside of the AC heater 17*a*. The insulating sheet 17*c*, which is made of polyimide and has a thickness of 25 μm, is attached to an underside of the DC heater 17*b*.

Figure 9A:
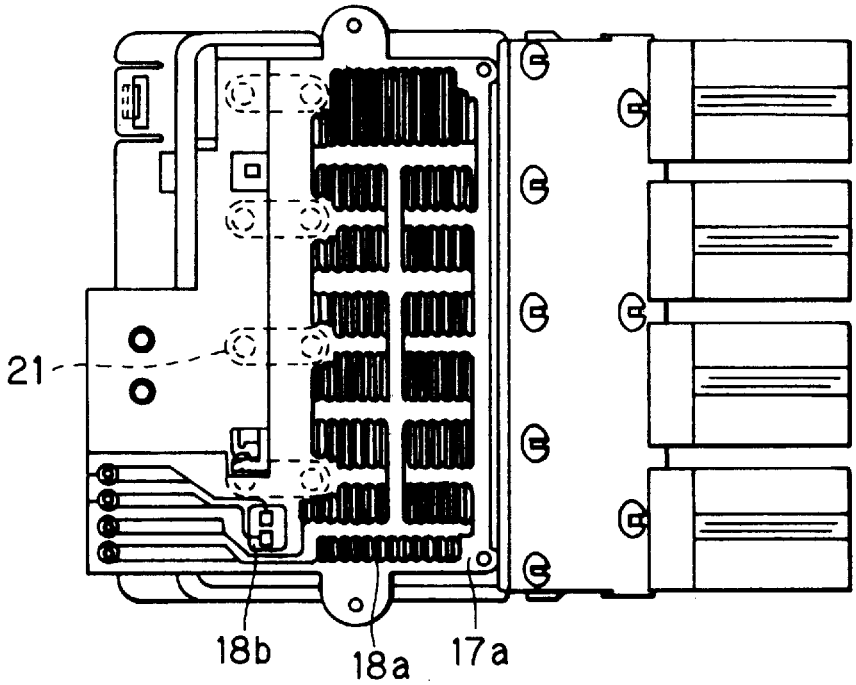
FIG. 9(*a*) is a plan view of an ink tank heater 17 according to the embodiment of the present invention.
Figure 9B:
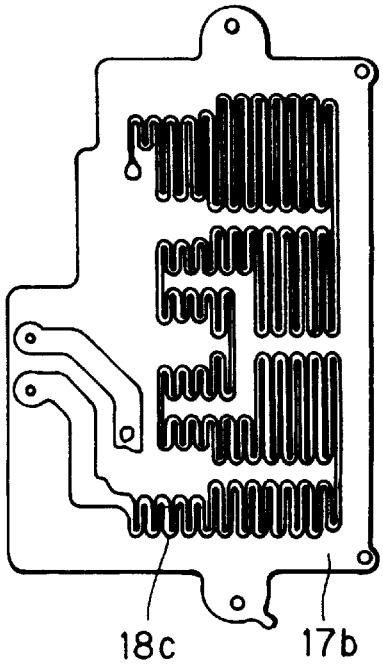

As shown in FIG. 9(*a*), the AC heater 17*a* includes an electrical resistance wire 18*a*, a thermistor 18*b*, and a polyimide insulating sheet on which the wire 18*a* and the thermistor 18*b* are mounted. The wire 18*a* is formed by etching a stainless steel having a thickness of 30 μm so as to form a meandered pattern. The meandered pattern is formed outside a region where the channel 21 is formed. The thermistor 18*b* is serving as a temperature sensor. The polyimide insulating sheet has a thickness of 25 μm.

The DC heater 17*b* includes a polyimide insulating sheet having a thickness of 25 μm and an electrical resistance wire 18*c* mounted thereon. The wire 18*c* is formed by etching a stainless steel to from a meandering pattern. The meandered pattern is formed so that the electrical resistance wire 18*c* will not be provided at portions under the channels 21.

Figure 5:
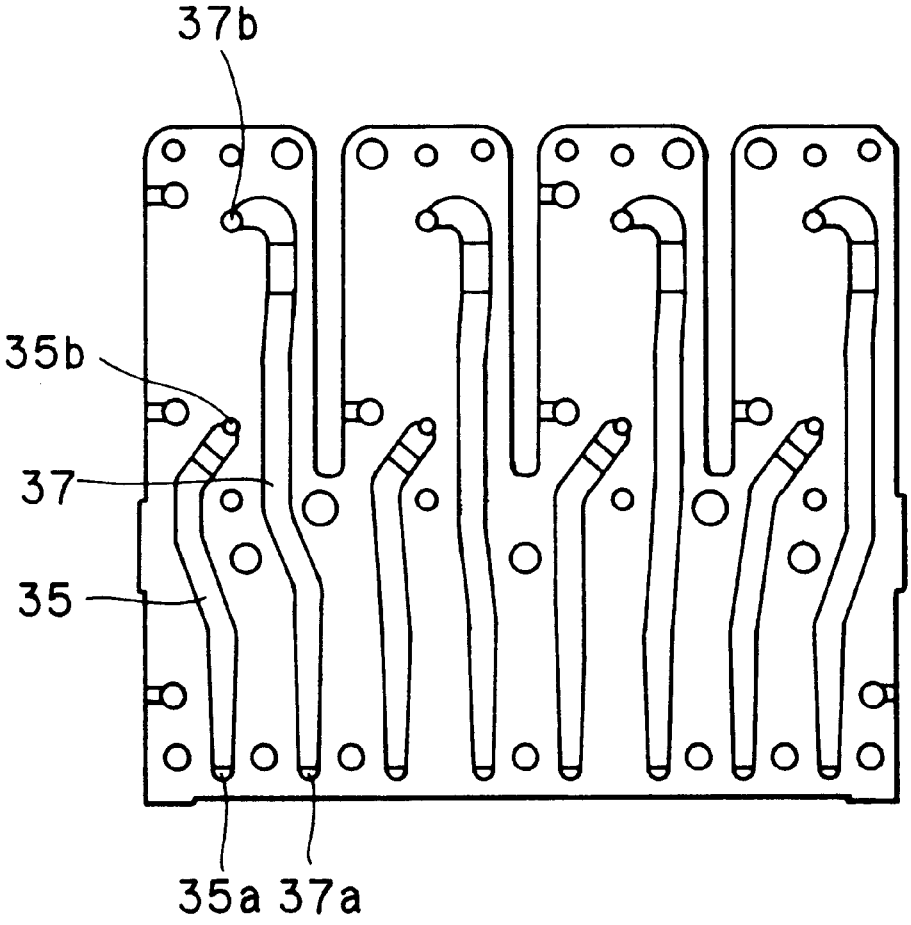
FIG. 5 is a plan view showing an internal surface of a front panel 30 according to the embodiment of the present invention.

As shown in FIG. 2, four nozzle heads 31 are attached to an outer surface of the front panel 30, and a cover panel 30*a* is attached to an inner surface of the front panel 30. As shown in FIG. 5, the inner surface of the front panel is formed with outgoing channel inlets 35*a*, outgoing channel outlets 35*b*, returning channel inlets 37*b*, and returning channel outlets 37*a*. Also, the front panel 30 and cover panel 30*a* together form outgoing channels 35 and returning channels 37. Each outgoing channel 35 is in a fluid communication with the corresponding main chamber 11 and the nozzle head 31 via outgoing channel inlet 35*a* and outgoing channel outlet 35*b*, respectively. Also, each returning channel 37 is in a fluid communication with the corresponding sub chamber 13 and the nozzle head 31 via returning channel outlet 37*a* and returning channel inlet 37*b*, respectively. As shown in FIG. 2, a front panel heater 33 is attached to the cover panel 30*a*.

As shown in FIG. 8, the outgoing channel 35 and the returning channel 37 are connected to two channels formed in the nozzle head 31 at a lower fork 31*a* and an upper fork 31*b*, respectively. As indicated by arrows in FIG. 8, ink stored in the main chamber 11 can flow through the outgoing channel 35, the outgoing channel outlet 35*b*, and the lower fork 31*a* to the nozzle head 31, and further through the upper fork 31*b*, the returning channel inlet 37*b*, and the returning channel 37 and into the sub chamber 13. Each nozzle head is formed with 128 nozzles 32. The nozzles 32 are arranged to form two parallel rows each containing 64 nozzles 32. It should be noted that piezoelectric elements 38 form ink channels (not shown in the drawings) each in a fluid communication with the corresponding nozzle 32. When the piezoelectric elements 38 deforms, an internal pressure of the ink channel is changed. As a result, ink filling in the ink channel is ejected from the nozzles 32 as an ink droplet toward a printing medium, thereby forming an printed image.

Each nozzle 32 is numbered from 1 to 128. More specifically, in FIG. 8, the nozzles in a right row are odd numbered increasing from bottom to top, and the nozzles in a left row are even numbered increasing from bottom to top. That is, a lowest nozzle in the right row is a nozzle No. 1, and a lowest nozzle in the left row is a nozzle No. 2. Also, a highest nozzle in the right row is a nozzle No. 127, and a highest nozzle in the left row is a nozzle No. 128.

The front panel heater 33 includes a lower polyimide insulating sheet, a first DC heater 33*x*, a second DC heater 33*y*, a thermistor 33*z*, and an upper polyimide insulating sheet. Both the lower and upper polyimide insulating sheets have a thickness of 25 μm. The first DC heater 33*x* serves as an outer electrical resistance wire, and the second DC heater 33*y* serves as inner electrical resistance wire. The first DC heater 33*x* and the second DC heater 33*y* are formed by etching a stainless steel having a thickness of 30 μm so as to form a meandering pattern, and both are mounted on the lower polyimide insulating sheet. The thermistor 33*z* serves as a temperature sensor and is mounted on the lower polyimide insulating sheet at a substantially center position. The upper polyimide insulating sheet is mounted over the lower polyimide insulation sheet so that the first DC heater 33*x*, the second DC heater 33*y*, and the thermistor 33*z* are sandwiched therebetween.

Figure 10A:
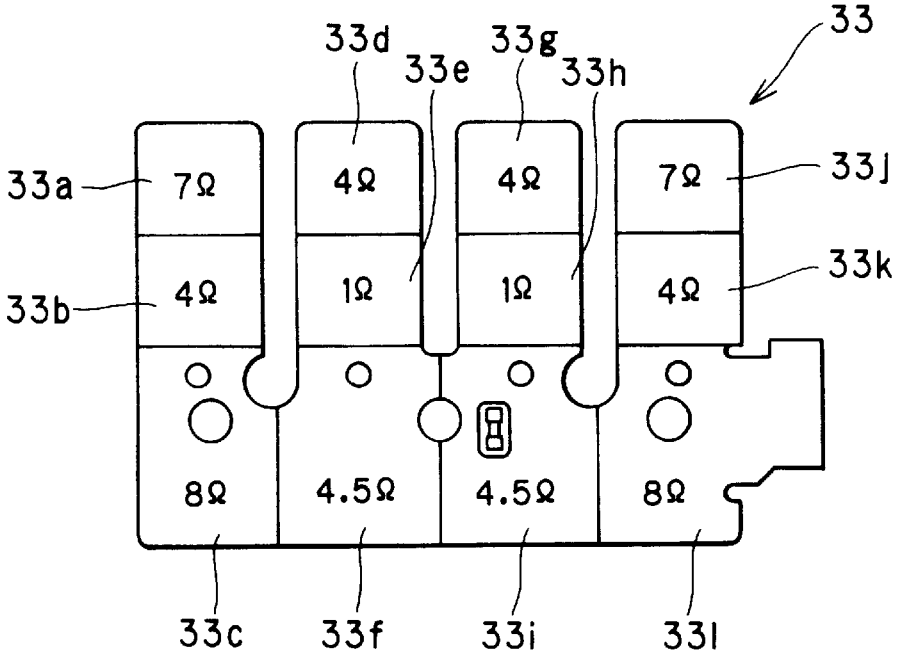
FIG. 10(*a*) is an explanatory view of a front panel heater 33 according to the embodiment of the present invention.
Figure 10B:
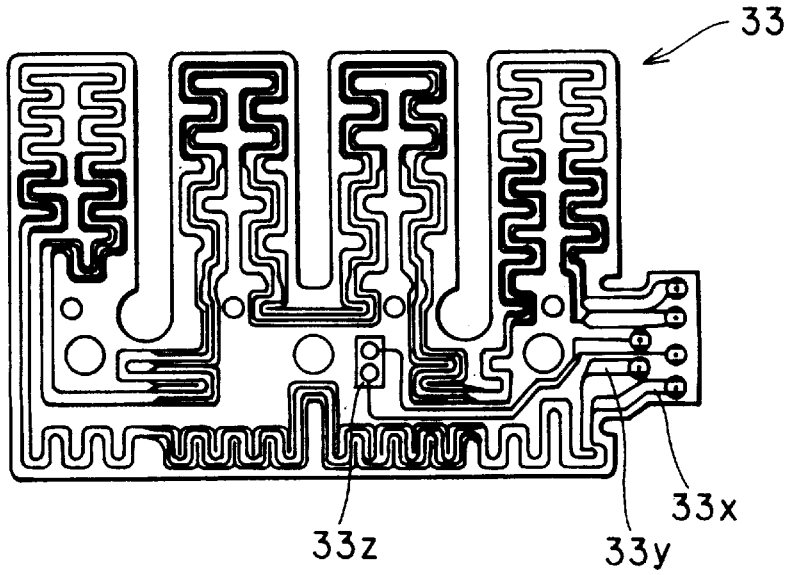

As shown in FIG. 10(*a*), the front panel heater 33 is divided into twelve heating regions 33*a* through 331 each having a different wattage density. More specifically, the front panel heater 33 is divided into four heating regions in a X direction, each for a respective nozzle head 31. Also, the front panel heater 33 is further divided into three heating regions in a Y direction, one for a region below the nozzle head 31, that is, where the outgoing channel 35 and returning channel 37 are formed, and two for the nozzle head 31. It should be noted that the X direction is a print head moving direction, while the Y direction is a direction perpendicular to the X direction. A wattage density of each of the heating regions 33*a* through 33*l* is determined by a thickness and a length of the electrical resistance wires mounted thereon. In the present embodiment, as shown in FIG. 10(*a*), the first DC heater 33*x* and the second DC heater 33*y* are formed so that each of the heating regions will have a predetermined wattage density. Specifically, the heating regions 33*a*, 33*j* in the upper corners of the front panel heater 33 have an electrical resistance of 7Ω. The heating regions 33*c*, 331 in the lower corners have an electrical resistance of 8Ω. The heating regions 33*e*, 33*h*, which are surrounded by other heating regions, have an electrical resistance of 1Ω. The lower central hating regions 33*f*, 33*i* have an electrical resistance of 4.5Ω. The remaining regions 31, 33*b*, 33*d*, 33*g*, and 33*k* have an electrical resistance of 4Ω. That is, the heating regions 33*a*, 33*c*, 33*j*, and 331, which tend to lose a large amount of heat, are set to have a higher electrical resistance. On the other hand, the heating regions 33*e*, 33*h*, which are surrounded by the other heating regions and lose less heat, are set to have a smaller electric resistance.

As shown in FIGS. 6 and 7, the cam 50 is mounted on the ink tank top cover 19 and slidable in a left-right direction in the drawings. The cam 50 is formed with a contact surface 50*a*, four cam surfaces 50*b*, and a protrusion 52 at a left end portion. A spring 51 is provided between the protrusion 52 and a protrusion 19*e* which is formed on the ink tank top cover 19. The spring 51 keeps the surfaces 50*b* from contacting with the top end members 24*a* of the levers 24. At the same time, the contact surface 50*a* protrudes over the ink tank top cover 19.

Next, the melting tank 40 will be described while referring to FIGS. 12 and 13.

Figure 12:
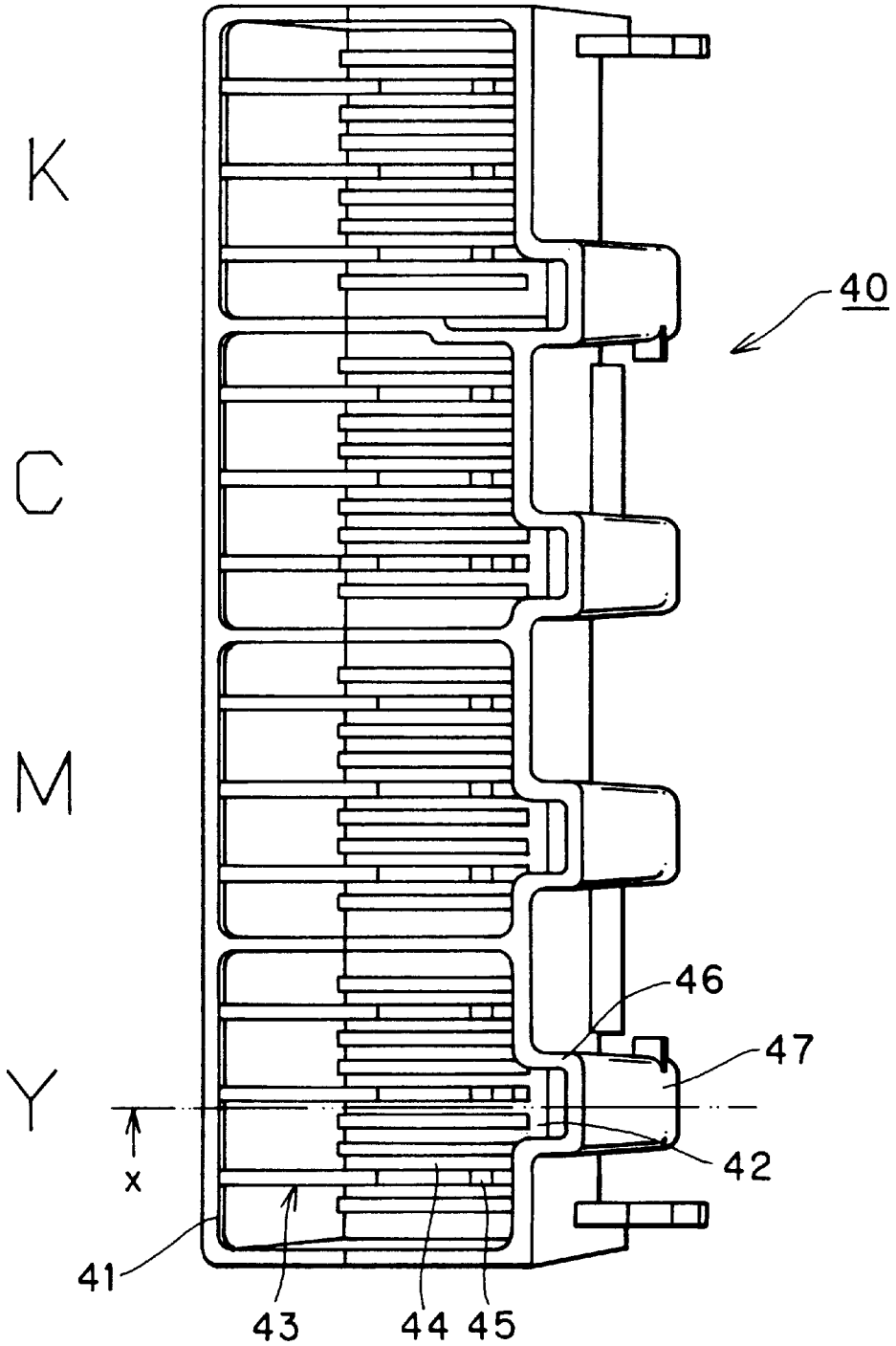
FIG. 12 is a cross-sectional view showing a melting tank 40 according to the embodiment of the present invention.

As shown in FIG. 12, the melting tank 40 of the present embodiment is divided into four compartments 41 each storing one of black ink (K), cyan ink (C), magenta ink (M), and yellow ink (Y). Each compartment 41 has an open top through which an ink adding mechanism, not shown in the drawings, supplies solid phase ink thereto. The compartment 41 includes a slanted bottom surface 42 formed with a plurality of ribs 43 and protrusions 45. Also, the compartment 41 is formed with an open hole 46 at a lower area of the slanted bottom surface 42 and a guiding passage 47. The plurality of ribs 43 defines gutters 44 aligned in parallel to one another and led to the guiding passage 47. The protrusions 45 are formed on ends of the ribs 43 near the guiding passage 47. Some of the ribs 43 extend upward along a wall of the compartment 41. A melting tank heater 48 is attached underside of the slanted bottom surface 42.

Figure 13:
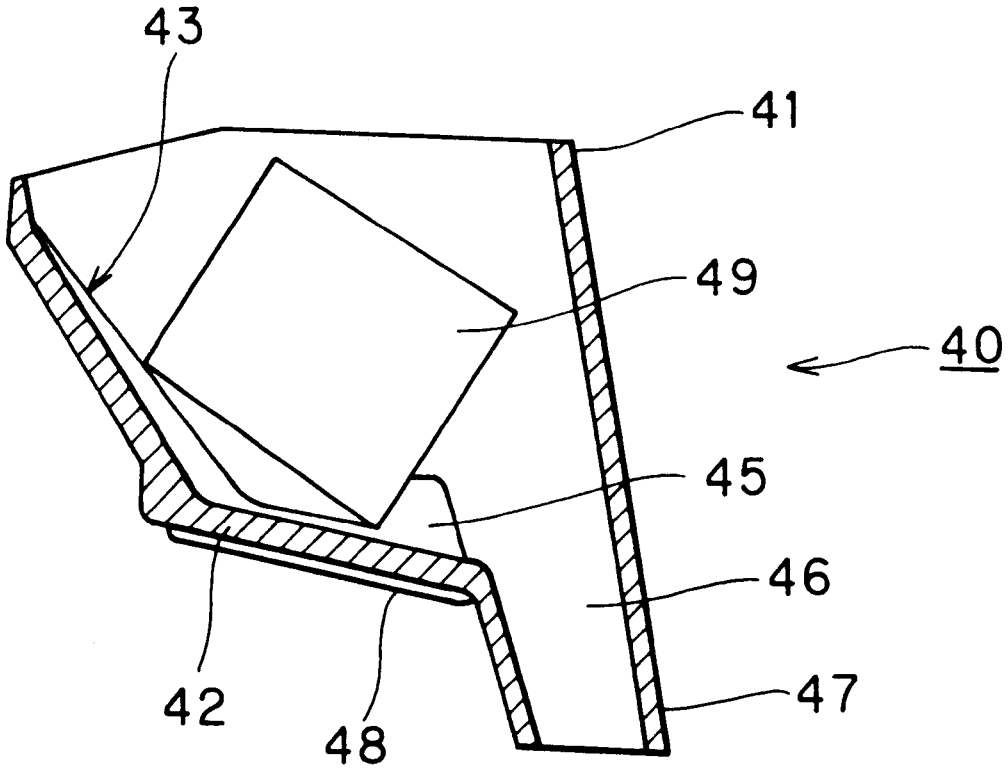
FIG. 13 is a cross-sectional view taken along a line X—X of FIG. 12.

As shown in FIG. 13, a solid phase ink 49 introduced into the melting tank 40 rests on the ribs 43 and is supported by the protrusions 45. After the melting tank heater 48 starts generating heat, the heat is transmitted to the ribs 43 of the melting tank 40. Then, the solid phase ink 49 is heated up and melted down. The liquid phase ink 49 flows down through the gutters 44, the open hole 46, and the guiding passage 47, and is supplied to the sub chambers 13 of the ink tank 10.

In conventional print heads, solid phase ink may cover up an open hole, and ink may not be supplied until the solid phase ink has completely melted. However, in the present embodiment, the solid phase ink 49 is melted while placed on the ribs 43 and supported by the protrusions 45. Therefore, liquid phase ink can flow along the gutters 44 and enter to the open hole 46 without the solid phase ink blocking the open hole 46. Also, a high heat transmitting efficiently can be expected.

The control substrate base 70 includes a control substrate, not shown in the drawings, and is mounted on the print head 1. A carriage motor 821, to be described later, moves the print head 1 in the X direction within a predetermined range, which includes a rapid heating position, a purging position, and a home position. When the print head 1 is in the rapid heating position, the AC heater 17*a* and the second DC heater 33*y* are connected to power sources to rapidly heat up the print head 1. The purging operation is performed when the print head 1 is in the purging position. The home position is a normal standby position of the print head 1 during the printing operation. Details will be described later. In the present embodiment, the rapid heating position is at a leftmost position within the range, and the purging position is at a rightmost position. The home position is set between the rapid heating position and the purging position. It should be noted that during the printing operation, the DC heater 17*b* and the first DC heater 33*x* are constantly operating.

Figure 14:
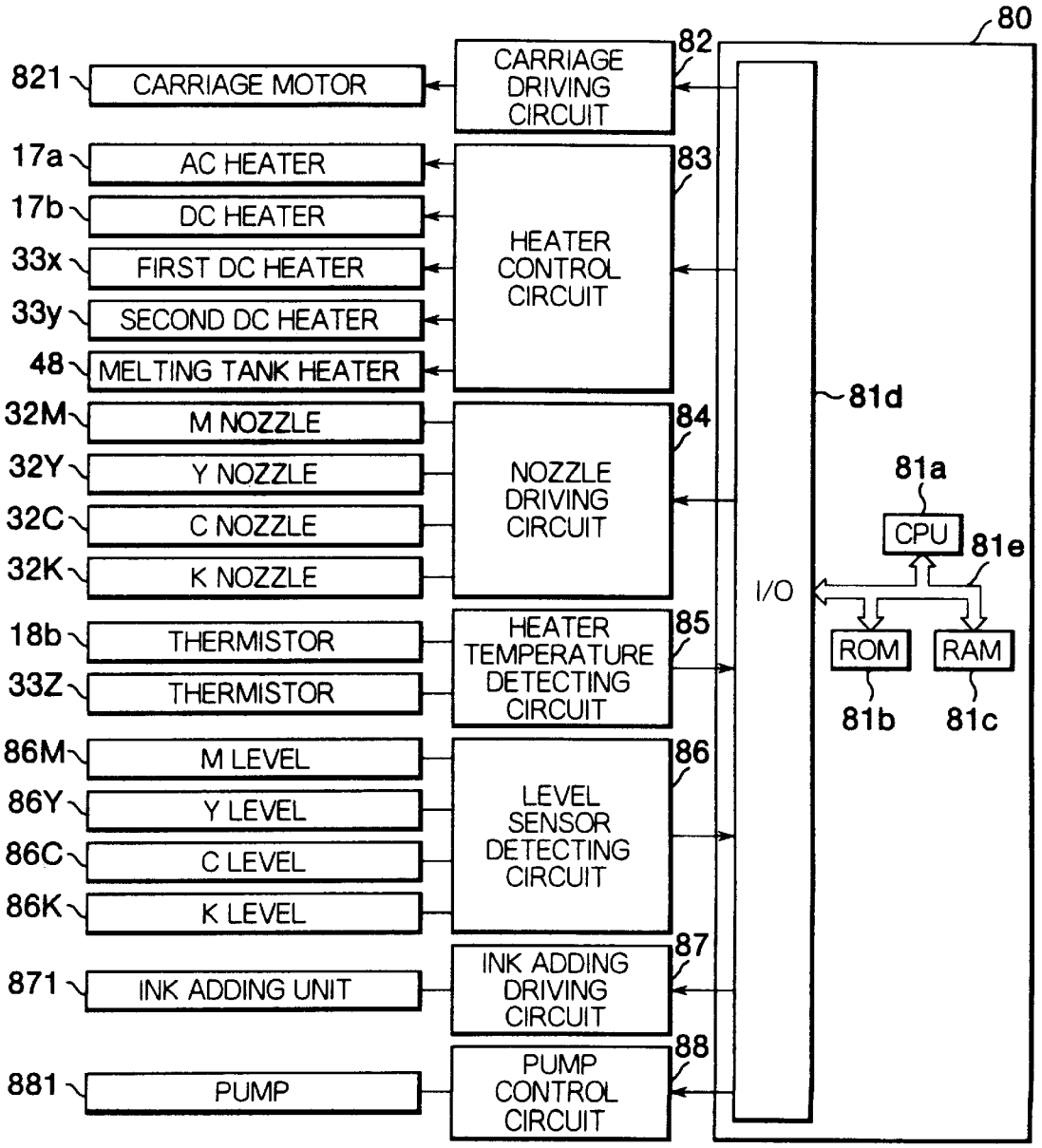
FIG. 14 is a block diagram showing a structure of a control system of the print head 1.

Next, a control system will be described while referring to a block diagram shown in FIG. 14. A driver unit 80 includes a CPU 81*a*, a ROM 81*b*, a RAM 81*c*, an I/O port 81*d*, and bus lines 81*e*. The CPU 81*a* executes logical calculations. The ROM 81*b* sRAM 81*c* temps programs, and the RAM 81*c* temporarily stores data. All of the above component are connected with each other via the bus lines 81*e*.

The I/O port 81*d* are connected with a carriage driving circuit 82, a heater control circuit 83, a nozzle driving circuit 84, an ink adding mechanism driving circuit 87, a pump control circuit 88, a heater temperature detecting circuit 85, and a level detecting circuit 86. The carriage driving circuit 82 controls the carriage motor 821 serving as a driving source of the print head 1. The heater control circuit 83 controls ON and OFF of the heaters 17*a*, 17*b*, 33*x*, 33*y*, and 48 which heat up and maintain temperatures of the ink tank 10, the front panel 30, and the melting tank 40. The nozzle driving circuit 84 controls ejection of ink from the nozzles 32M, 32Y, 32C, 32K. The ink adding mechanism driving circuit 87 controls the ink adding mechanism 871 to supply solid phase ink into the melting tank 40. The pump control circuit 88 controls ON and OFF of a pump 881 to inject air into the ink tank 10 during the purging operation. The heater temperature detecting circuit 85 detects temperatures of the ink tank heater 17 and of the front panel heater 33 based on currents outputted from the thermistors 18*b* and 33*z*, and outputs temperature data. The level detecting circuit 86 detects ink levels in the main chambers 11 based on currents outputted from the thermistors 86M, 86Y, 86C, and 86K, and outputs ink level data.

Figure 15:
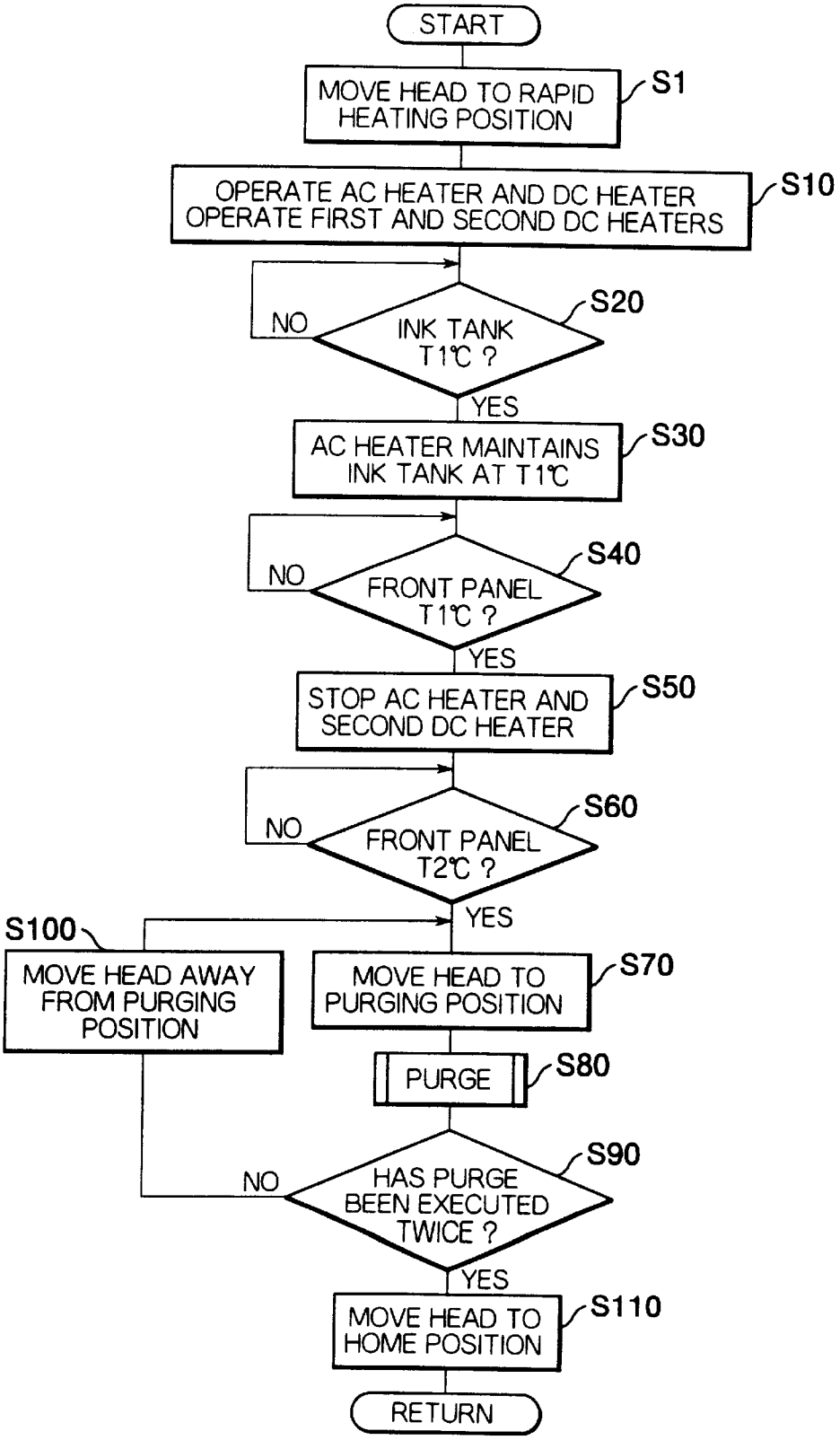
FIG. 15 is a flowchart representing control processes during preparatory operation of the print head 1.
Figure 17:
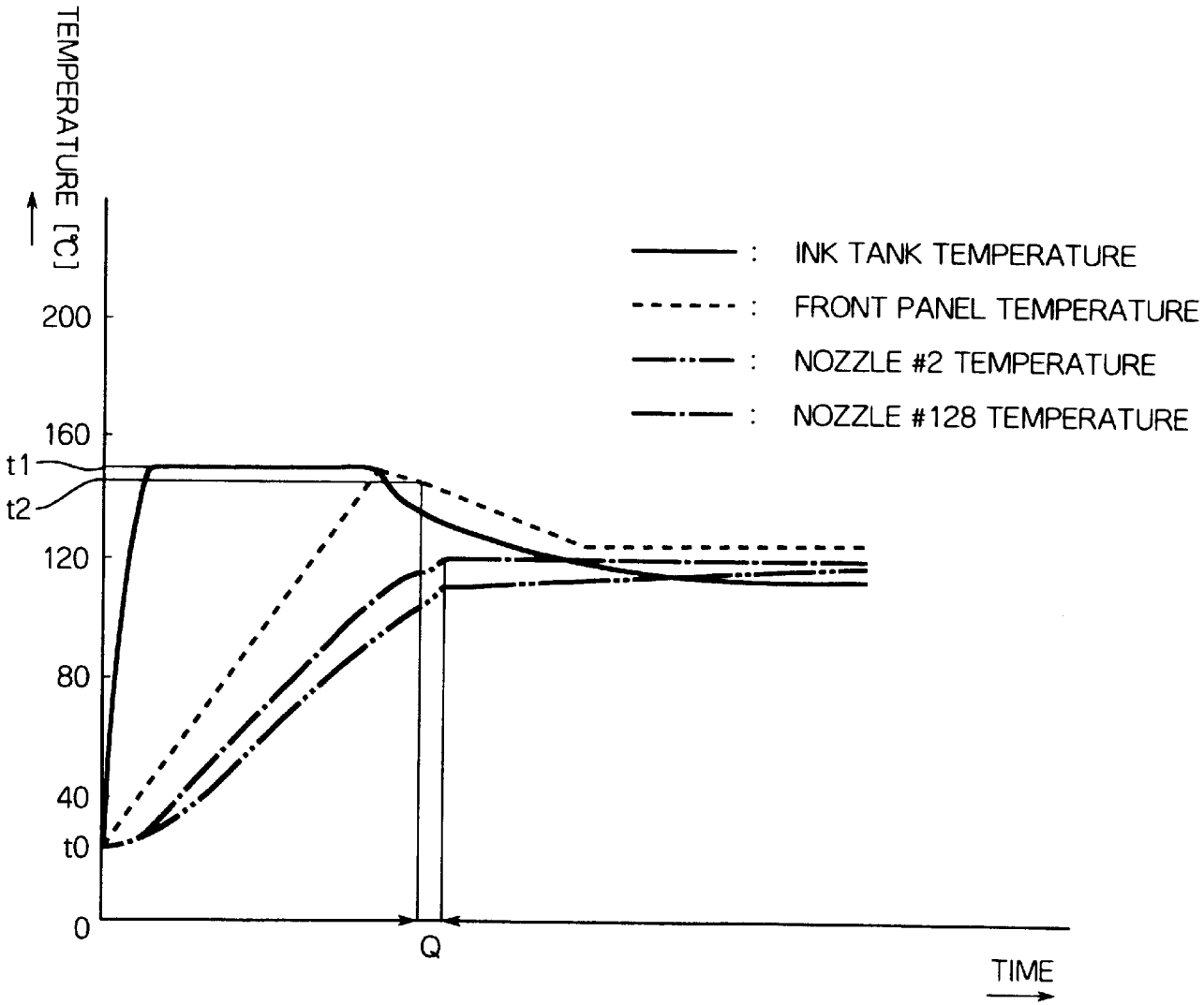
FIG. 17 is a graph showing temperature changing in the print head 1.

Next, control process for the preparatory operations, will be described while referring to FIGS. 15, 17. It should be noted that all control processes are executed by the CPU 81*a* controlling each of the control circuits 82 to 88.

When the printer is started up, first, the carriage motor 821 moves in SI the print head 1 to the rapid heating position. Then, the AC heater 17*a*, the DC heater 17*b*, and the first and second DC heaters 33*x*, 33*y* start generating heat in S10 to heat up the ink tank 10 and the front panel 30. At this point, the ink tank 10 and the front panel 30 are at a room temperature t0. The heaters 17*a*, 17*b*, 33*x*, 33*y* keep heating the ink tank 10 and front panel 30 until their temperatures reach a predetermined temperature t1, for example, 150° C. Because the ink tank 10 is heated by the AC heater 17*a*, the ink tank 10 increase its temperature faster than the front panel 30. Temperature of the nozzle head 31 is also increased toward the predetermined temperature. Specifically, in the present embodiment, temperatures of the nozzles No. 2, No. 128 represent that of the nozzle head 31.

Next, the heater temperature detecting circuit 85 detects in S20 the temperature of the thermistor 18*b* and then, determines whether or not ink tank 10 has reached the predetermined temperature t1. If not (S20:NO), S20 is repeated. On the other hand, if so (S20:YES), the process proceeds to S30.

In S30, the heater control circuit 83 controls the AC heater 17*a* to maintain the ink tank 10 at the predetermined temperature t1 based on temperature data detected by the thermistor 18*b*. Also, at the same time, the front panel 30 keeps increasing its temperature toward the predetermined temperature t1.

Next, the heater temperature detecting circuit 85 detects in S40 the temperature of the thermistor 33*z* and then, determines whether or not the front panel 30 has reached the predetermined temperature t1. If not (S40:NO), S4 is repeated. On the other hand, if so (S40:YES), the process proceeds to S50.

Then, the heater control circuit 83 turns OFF in S50 the AC heater 17*a* and the second DC heater 33*y*. As a result, as shown in FIG. 17, the temperatures of the thermistor 33*z* and the thermistor 18*b* start decreasing. However, the nozzles No. 2, No. 128 continue increasing their temperature due to heat transmitted from the front panel 30.

Next, the heater temperature detecting circuit 85 detects the temperature of the thermistor 33*z* in S60 and then, determines whether or not the temperature of the front panel 30 has dropped down to a predetermined temperature t2. If not (S60:NO), S60 is repeated. On the other hand, if so (S60:YES), the process proceeds to S70.

In S70, the carriage motor 821 moves the print head 1 to the purging position. As a result, the contact surface 50*a* of the cam 50 is pressed against a frame 54 of the printer body (see FIG. 6). The cam 50 slides toward the left relative to the ink tank top cover 19. Then, the cam surface 50*b* push down the top end member 24*a* of the lever 24. The lever 24 pivots around the lever fulcrum 25, thereby releasing the pressure weld of the pressure welding valve 28 and sub chamber inlet 22*b*. As the lever 24 pivots farther, the pressure welding valve 27 and sub chamber outlet 21*b* are pressure welded. In this way, the sub chamber inlet 22*b* is opened, and the sub chamber outlet 21*b* is closed.

Then, a purging operation is executed in S80. First, the pump 881 introduces air into the main chamber 11 through the through hole 20*b*, the air chamber 20, and through hole 23, thereby increasing an internal air pressure of the main chamber 11. Because the sub chamber outlet 21*b* is in a closed condition, and because the sub chamber inlet 22*b* is in an open condition, the ink with the air bubbles in the main chamber 11 is forced to flow through the main chamber outlet 22*a*, the outgoing channel inlet 35*a*, the outgoing channel 35, outgoing channel outlet 35*b*, the nozzle head 31, the returning channel inlet 37*b*, the returning channel 37, the returning channel outlet 37*a*, and sub chamber inlet 22*b* and reaches to the sub chamber 13.

Next, the CPU determines in S90 whether or not the purging operation has been performed twice. If not (S90:NO), the process proceeds to S100. On the other hand, if so (S90:YES), the process proceeds to S110. In S100, the carriage motor 821 moves the print head 1 slightly off of the purging position. Then, the contact surface 50*a* of the cam 50 is separated from the frame 54 of the printer body. The spring 51 urges the cam 50 to slide toward the right relative to the ink tank top cover 19. As a result, the cam surface 50*b* opens the top end member 24*a*. Then, the lever 24 pivots around the lever fulcrum 25 due to the spring 26. The pressure weld between the pressure welding valve 27 and the sub chamber outlet 21*b* is opened. As the lever 24 pivots farther, a pressure weld is formed between the pressure welding valve 28 and the sub chamber inlet 22*b*. In this way, the sub chamber inlet 22*b* is closed, and the sub chamber outlet 21*b* is opened. At the same time, leveling is performed. It should be noted that leveling is a process to make the ink levels in the main chamber 11 and the sub chambers 13 the same. That is, ink, which is sent to the sub chamber 13 during the purging operation, is returned to the main chambers 11 through the channel 21.

As described above, in accordance with the movement of the print head 1, the pressure welding valves 27 and 28 close the sub chamber inlet 22*b* and open the sub chamber outlet 21*b*, respectively. Because opening and closing of the pressure welding valve 27 is performed using mechanical process, leveling can be quickly accomplished.

After leveling has been completed, the process returns to S70 for executing the purging operation. Then, the process proceeds to S80 and S90, and the carriage motor 821 moves in S110 the print head 1 to the home position.

With the control processes described above, the ink tank 10 and front panel 30, as well as ink in the print head, are maintained at the predetermined temperature. Particularly, executing the purging operation before the nozzles 32 reach the predetermined temperature is advantageous. Even though the nozzles 32 are still at a low temperature, ink circulated during the purging operation through the nozzle heads is high at the temperature. Heat is transmitted from the ink to the nozzles 32, thereby accelerating speed of increasing temperature of the nozzles 32.

Next, printing control processes will be described.

Once started the printing operation, the carriage motor 821 moves the print head 1 back and forth in the X direction. When the print head 1 is in a desired position, the piezoelectric elements 38 deforms, thereby ejecting ink as an ink droplet from each of the nozzles 32M, 32Y, 32C, 32K. In this way, a printed image is obtained.

Figure 16:
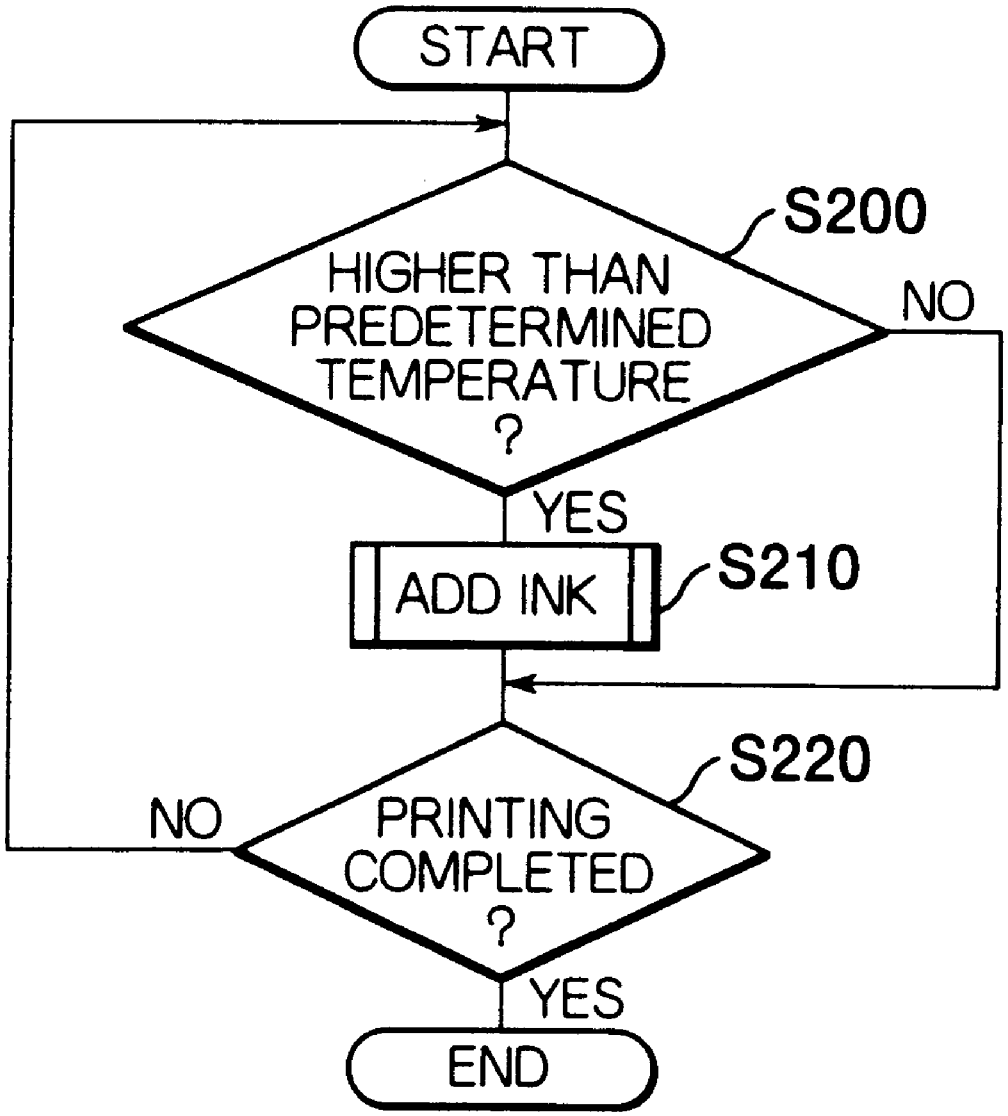
FIG. 16 is a flowchart representing control processes during in supplying operation of the print head 1.

Next, ink supply control processes to supply and melt solid phase ink 49 in the melting tank 40 will be described with reference to FIG. 16. This ink supply control processes are executed while the power of the ink-jet printer is ON. First, the thermistor 86 serving as a level sensor detects in S200 whether or not an ink level in the ink tank 10 is low. The thermistor 86 is provided in the ink tank 10 at a predetermined position. A current flows through the thermistor 86 at a predetermined regular interval, thereby the thermistor 86 generates heat and increases its own temperature. When the thermistor 86 is being submerged in ink, the temperature increases at a relatively low speed. On the other hand, when the thermistor 86 is being exposed in the air, the temperature increases at a relatively high speed. That is, the ink level can be detected by measuring time duration the thermistor 86 requires to reach a predetermined temperature. It should be noted that as the thermistor 86 increases its temperature, the thermistor 86 also increases its electrical resistance. As a result, less electric current flows through the thermistor 86. Therefore, the temperature of the thermistor 86 can be detected by detecting the electric current flowing through the thermistor 86. In this way, in S200, a time duration for the thermistor 86 to reach the predetermined temperature is measured and then, whether or not the measured time duration is shorter than a predetermined time duration is determined.

If so (S200:YES), ink adding processes are executed in S210. First, the carriage motor 821 moves the print head 1 to the ink adding position. Next, the ink adding mechanism 871 supplies the solid phase ink 49 into the melting tank 40. Then, the melting tank heater 48 is turned ON to start generating heat to melt the solid phase ink 49. On the other hand, if not (S200:NO), S200 is repeated.

Figure 18:
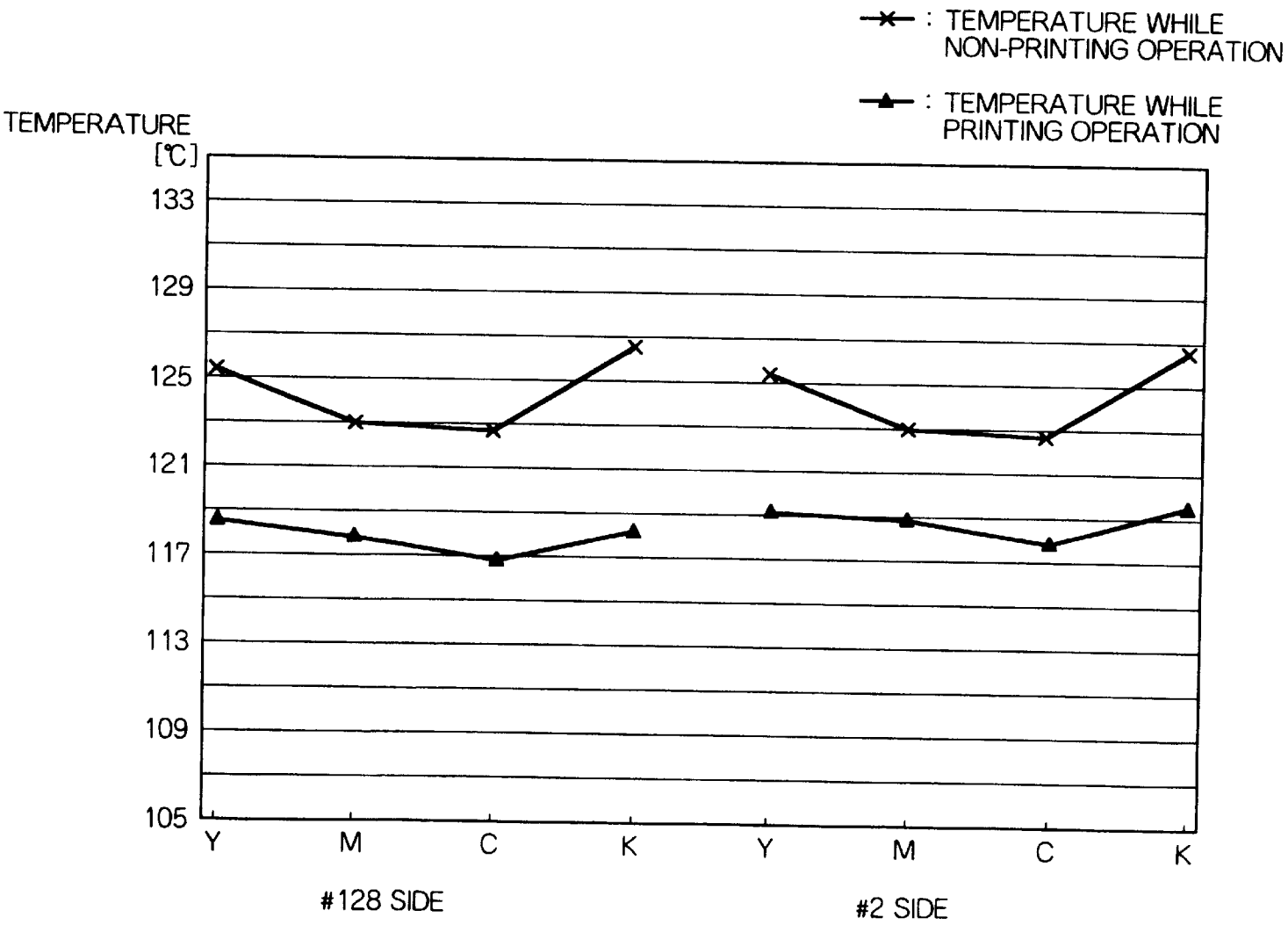
FIG. 18 is a graph showing temperature conditions of nozzle heads 31 according to the embodiment of the present invention.

In the present embodiment, the front panel heater 33 is divided into twelve heating regions, each having a different wattage density. When the printing device is in its ON state, the front panel 30 is maintained at about 130° C. among the nozzle heads 31Y, 31M, 31C, 31K, the nozzle heads 31Y, 31K are positioned on edges while the nozzle heads 31M, 31C are in a middle. That is, the nozzle heads 31Y, 31K are facing to the moving direction of the print head 1, and the nozzle heads 31M, 31C are not. As shown in FIG. 18, when the printing operation is not performed, the temperatures of the nozzles No. 2, No. 128 of the nozzle heads 31Y, 31K, are maintained at about 125° C., which is about 3° C. lower than that of the nozzle heads 31M and 31C, respectively. On the other hand, during the printing operation, the nozzles No. 2, No. 128 of each nozzle heads 31 are uniformly maintained at about 118° C. Because all of the nozzles 32 are at the same temperature, ink is ejected from the each nozzle head 31 at an uniform speed, thereby providing an excellent printed image.

Also, in addition to the DC heater 17*b* and first DC heater 33*x*, the AC heater 17*a* and the second DC heater 33*y* are provided to the ink tank 10 and the front panel 30, respectively. The AC heater 17*a* and the second DC heater 33*y* are serving as normal heating means while the AC heater 17*a* and the second DC heater 33*y* as rapid heating means. Therefore, ink in the ink tank 10 and in the front panel 30 can be quickly melted, thereby decreasing a timed duration required for the preparatory operation.

The AC heater 17*a* stops generating heat in a predetermined time duration after the printing device is started up. However, because the DC heater 17*b* continues generating heat, the ink tank 10 is prevented from abruptly decreasing its temperature. Similarly, the second DC heater 33*y* stops generating heat in a predetermined time duration after turning ON the printing device. However, the first DC heater 33*x* also continues generating heat, thereby preventing the front panel 30 from abruptly decreasing its temperature.

Further, because purging operation is executed at an early stage to circulate hot ink through the nozzle heads 31, it takes less time duration for the nozzle heads 31 to reach the predetermined temperature. Therefore, the propitiatory time duration can be further shortened. Needless to say, the air bubbles can be removed from the front panel 30 by the purging operation.

The under surface of the ink tank 10 is formed with the channels 21 when the ink tank 10 is manufactured. That is, it is unnecessary to process the ink tank 10 to form a hole for the channel 21 after the ink tank 10 has been once manufactured. This is less time consuming.

The ink tank heater 17 attached to the ink tank 10 includes the polyimide insulating sheet. This ink tank heater 17 prevents ink from leaking out of the ink tank 10. Also, the ink tank heater 17 can be formed thinner than conventional ones which include silicon rubber and have a thickness of 700-$\mu$m. Therefore, a volume of the ink tank 10 can be small. Also, by forming wire on the polyimide insulating sheet with avoiding a region where the channel 21 is formed, the ink tank heater 17 is prevented from being heated to extremely high temperature, such as 400 to 500° C., at the region even when the channel 21 is not filled with ink.

Further, in the present invention, the purging operation and prevention of the backward flow of ink during the printing operation is achieved by the simple pivoting operation of the lever 24. The lever 24 pivots to open and close the pressure welding valve 27, 28 in accordance with the movement of the print head 1. In this way, the smooth purging operation and prevention of the backward flow of ink during the printing operation is achieved. Therefore, no additional driving mechanism is necessary for controlling the pivotal movement of the lever 24. This simplifies the structure of the print head 1 and decreases manufacturing costs.

In order to operate smooth pivoting movement of the lever 24, only a slight gap can be allowed to be formed between the elongated opening 19*c* and the top end member of the lever 24 in a width direction. Then, ink is introduced in the gap due to the capillary action. However, because the lever 24 is formed from a die cast aluminum alloy, heat of liquid phase ink in the ink tank 10 is transmitted to the top end member 24*a*. Therefore, the ink in the gap will not be cooled off to be hardened, thereby the lever 24 can pivot reliably smoothly.

Because the die cast aluminum alloy is light, the lever 24 will not be suffered from a great inertial force even under a rapid pivotal movement. Also, because the die cast aluminum alloy is durable, the lever 24 will not wear quickly at portions subjected to friction. Therefore, in addition to preventing the hardening of ink, the die-cast aluminum alloy allows the lever 24 to operate smoothly for a long period of time.

Because of the lever 24 provided in the sub chamber 13, even when ink is ejected from the nozzles 32 during the printing operation, ink will not flow back to the returning channel 37 from the sub chambers 13. That is, air bubbles once sent to the sub chambers 13 during the purging operation will not return to the nozzles 32. Therefore, no deaerator nor a one-way valve are necessary. The one-way valve is employed in conventional print heads for allowing to maintain a higher ink level in the main chamber 11 than in the sub chamber 13, thereby preventing a reverse flow of ink. Also, the channels are able to have large diameters so that the leveling can be quickly completed after the purging operation. This further shorten the time duration required for the preparatory operation when the purging operation is performed more than once.

Because the pressure welding valves 27, 28 are provided on either end of the single lever 24, there is no need to provide a separate control process for each of the pressure welding valves 27, 28.

Because the cam 50 gradually pivots the lever 24, the lever 24 and the cam 50 can be prevented from being stuck by meshing with each other.

Further, because of the spring 26, the pressure welding valve 28 is normally closing the sub chamber inlet 22*b*, ink containing air bubbles is reliably prevented from flowing into the outgoing channels 35 and returning channels 37 from the sub chambers 13. Because the lever 24 is operated to pivot only during the purging operation, it simplifies control processes.

The filter 29 is made of the sintered stainless steel fibers which are complexly twisted and overlapped to form multiple layers in the thickness direction. Therefore, the filter 29 can filter even smaller particles than a pore diameter of the filter 29. Because the pore diameter does not need to be formed small, pressure loss can be lessened. In this way, printing problems due to foreign matter and pressure loss can be prevented. Because corrosion on stainless steel progresses very slowly, cost and time required for replacing the filter 29 can be reduced.

The solid phase ink is melted in the melting tank 40 while placed on the plurality of ribs 43 and supported by the protrusions 45. Then, liquid phase ink drips into the gutters 44 and is leaded to the open hole 46. Therefore, even when the ink becomes small, the solid phase ink will not plug up the open hole 46. For this reason, liquid phase ink guided by the gutters 44 to the open hole 46 can be smoothly provided to the ink tank 10.

Also, because the ribs 43 serve as heat-transfer fins, the solid ink can be melted efficiently. The melting tank heater 48 provided on the underside of the slanted bottom surface 42 can be easily exchanged in the event the heater becomes faulty.

When the ink level in the ink tank 10 is detected to be low, the ink adding mechanism automatically adds solid phase ink to the melting tank 40. Therefore, a user does not need to manually add solid phase ink to the melting tank 40.

As described above, the pressure welding valves 27, 28, the sub chamber outlet 21*b*, and the sub chamber inlet 22*b* have the uniquely shaped surfaces and edges. Also, the pressure welding valves 27, 28 are formed from silicone rubber which has an efficient elasticity. Therefore, the sub chamber out1ets 21*b* and sub chamber inlets 22*b* are closed with fine precision even if the relative positions of the pressure welding valves 27, 28 to the sub chamber out1ets 21*b* and sub chamber inlets 22*b*, respectively, are somewhat changed. More specifically, the lever 24 is forced to pivot against the constant urging force in order to close the sub camber outlet 21*b*. Therefore, the pressure welding valve 27 may not be placed at a precise position relative to the sub chamber outlet 21*b*. However, because of the spherically shaped valve surface, precise closing can be achieved. Also, because of the annualarly shaped surface, the pressure welding valve 28 can precisely close the sub chamber inlet 22*b* with the urging force which is weaker than the pivoting force acting against the urging force.

Further, a contacting area between the pressure welding valve 27 and sub camber outlet 21*b* is relatively large, cracking on the surface and the edge due to an excessive pressure can be prevented.

Ink is kept at about 120° C. during the printing operation. On the other hand, the silicone rubber has a heat resistance of 200° C. and a high corrosion resistance. Therefore, the silicone rubber can retain a precise close even after being immersed in ink for a long period of time. In addition, the silicone rubber is relatively easy to obtain and easily processed. It eases production of the pressure welding valves 27, 28. Also, because the fluorine-containing rubber has a heat resistance of 250° C. and a high corrosion resistance, the fluorine-containing rubber is also appropriate material for the valves.

What is claimed is:

1. A head mounted on a slidable carriage for use on a hot melt ink jet printer having a frame, the head comprising:

an ink tank that stores ink and is formed with a first chamber and a second chamber, the ink tank including a bottom wall, that lies in a single plane, to the first chamber and the second chamber, the bottom wall lying in the single plane being formed with a cave-in with a first through hole at a first chamber side and a second through hole at a second chamber side, the cave-in and the holes together forming a first channel connecting between the first chamber and the second chamber;

a nozzle head that ejects the ink;

a front panel that mounts the nozzle head, the front panel being formed with a second channel connecting between the first chamber and the nozzle head and a third channel connecting between the nozzle head and the second chamber so that the ink is allowed to flow from the first chamber to the second chamber via the nozzle head;

a tank heater that heats the ink tank, the tank heater being attached to the bottom wall lying in the single plane while enclosing the first channel; and a panel heater that heats the front panel, the panel heater being attached to the front panel.

2. The head according to claim 1, wherein the tank heater includes a substrate and a wire formed in a meandering pattern, the meandering pattern being formed outside a region where the first channel is formed.

3. The head according to claim 2, wherein the substrate is an insulating sheet made of polyimide.

4. The head according to claim 1, further comprising:

a first detecting device that detects a temperature of the ink tank;

a second detecting device that detects a temperature of the front panel;

tank heater control means connected to the first detecting device, for controlling the tank heater; and panel heater control means connected to the second detecting device, for controlling the panel heater; wherein:

the tank heater includes a first tank heater and a second tank heater, the first tank heater heats and maintains the ink tank at a first predetermined temperature, and the second tank heater heats the ink tank;

the panel heater includes a first panel heater and a second panel heater, the first panel heater heats and maintains the front panel at a second predetermined temperature, and the second panel heater heats the front panel; and when the printer is powered ON, the tank heater control means starts driving the first tank heater and the second tank heater for a first predetermined time duration, and the panel heater control means starts driving the first panel heater and the second panel heater for a second predetermined time duration.

5. The head according to claim 4, wherein the tank heater control means turns OFF the second tank heater after the first predetermined time duration has been elapsed from power ON of the printer, and the panel heater control means turns OFF the second panel printer after the second predetermined time duration has been elapsed from said power ON of the heater.

6. The head according to claim 5, further comprising purging means for executing a purging operation during which the ink is circulated from the first chamber to the second chamber through the second channel, the nozzle head, and the third channel, the purging means executing the purging operation before the nozzle head reaches the second predetermined temperature after the ink tank has reached the first predetermined temperature.

7. The head according to claim 5, wherein the first tank heater, the first panel heater, and the second panel heater are DC heaters, and the second tank heater is an AC heater.

8. The head according to claim 1, wherein:

the nozzle head is formed with a plurality of nozzles aligned in a nozzle alignment direction;

the front panel is divided into an upper part and a lower part in the nozzle alignment direction, wherein the nozzle head is mounted on the upper part, and the lower part is formed with the second channel and the third channel;

the panel heater is divided into at least three heating regions in the nozzle alignment direction, and at least two heating regions in the nozzle alignment direction of the at least three heating regions heat the upper part, and a lowest heating region of the at least three heating regions in the nozzle alignment direction heats the lower part, and each of the at least three heating regions in the nozzle alignment direction has a smaller wattage density toward a center in the nozzle alignment direction.

9. The head according to claim 8, further comprising:

at least two other nozzle heads wherein the nozzle head and the at least two other nozzle heads are mounted on the front panel and aligned in a nozzle head alignment direction perpendicular to the nozzle alignment direction, each of the at least three nozzle heads ejecting one of different colored inks;

the front panel is formed with at least three groups of the second channels and the third channels with each group provided to a respective nozzle head; and the panel heater is divided into at least three heating sections in the nozzle head alignment direction with each heating section provided to a respective nozzle head, each of the at least three heating sections having a smaller wattage density toward a center in the nozzle head alignment direction.

10. The head according to claim 1, further comprising:

a first valve provided to the second chamber, the first valve selectively opening and closing the third channel from the second chamber;

a second valve provided to the second chamber, the second valve selectively opening and closing the first channel from the second chamber; and a valve control unit that executes a purging operation during which the ink is sent from the fist chamber to the second chamber via the nozzle head, the purging operation is executed by controlling the first valve and the second valve; wherein during the purging operation, the first valve opens the third channel, and the second valve closes the first channel; and during a time when the purging operation is not performed, the first valve closes the third channel, and the second valve opens the first channel.

11. The head according to claim 10, wherein:

the bottom wall is formed with a protrusion at the second chamber side between the first channel and the third channel;

the valve control unit includes a lever having an arm which is extended in a horizontal direction and has two ends, the lever mounting the first valve on one end and the second valve on another end, the lever pivotably mounted on the protrusion so that the second valve opens the first channel when the first valve closes the third channel, and vice versa.

12. The head according to claim 11, wherein the valve control unit further includes an urging member that urges the lever to close the third channel with the first valve and a counter member that counter-urges the lever to close the first channel with the second valve.

13. The head according to claim 11, the carriage is slidable toward and away from a purging position at which the purging operation is performed;

the ink tank includes a top cover formed with an opening;

the lever includes an upright portion extending upward from the arm, the upright portion protruding through the opening;

the valve control unit includes an urging member that urges the lever to close the third channel with the first valve and a sliding member attached to the upright portion; and when the carriage moves toward the purging position, the sliding member is brought into abutment with the frame of the printer, and the lever is urged to close the first channel with the second valve.

14. The head according to claim 13, wherein the sliding member includes a cam having a profile to gradually press the upright portion of the lever to thereby pivot the lever.

15. The head according to claim 14, wherein the arm and the upright portion are made from a metal.

16. The head according to claim 14, wherein the arm and the upright portion are made from an aluminum alloy.

17. The head according to claim 10, wherein the first valve has a flat contact surface that is engageable with the third channel, and the second valve has a spherically shaped contact surface that is engageable with the first channel.

18. The head according to claim 17, wherein the first channel has an tapered edge at the second chamber, and the third channel has an annularly shaped edge protruding upwardly at the second chamber.

19. The head according to claim 18, wherein the tapered edge and the annularly shaped edge are made from an elastomer which has a heat and corrosion resistance.

20. The head according to claim 19, wherein the flat contact surface and the spherically shaped contact surface are formed from an elastomer which has a heat and corrosion resistance.

21. The head according to claim 20, wherein the elastomer has a thermal resistance of 120° C. or more.

22. The head according to claim 21, wherein the elastomer is made from a silicon rubber.

23. The head according to claim 22, wherein the elastomer is made from a fluorine-containing rubber.

24. The head according to claim 10 further comprising a filter provided to the first chamber over the second channel, wherein the filter has a three dimensional structure.

25. The head according to claim 24, wherein the filter is made from sintered metal fibers.

* * * * *